US008033528B2

(12) United States Patent
Hoffend, III

(10) Patent No.: US 8,033,528 B2
(45) Date of Patent: Oct. 11, 2011

(54) LIFT ASSEMBLY, SYSTEM, AND METHOD

(75) Inventor: Donald A. Hoffend, III, Winston-Salem, NC (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 12/856,873

(22) Filed: Aug. 16, 2010

(65) Prior Publication Data

US 2010/0301292 A1 Dec. 2, 2010

Related U.S. Application Data

(63) Continuation of application No. 11/796,781, filed on Apr. 30, 2007, now Pat. No. 7,775,506.

(60) Provisional application No. 60/873,389, filed on Dec. 7, 2006, provisional application No. 60/796,362, filed on Apr. 28, 2006.

(51) Int. Cl.
*B66D 1/36* (2006.01)

(52) U.S. Cl. ..... 254/286; 254/394; 160/143; 160/331

(58) Field of Classification Search ..... 254/278, 254/279, 286, 287, 294, 316, 338, 394; 160/331, 160/344, 143
See application file for complete search history.

(56) References Cited

U.S. PATENT DOCUMENTS 1,002,839 A 9/1911 Hagen
1,435,390 A 11/1922 Hasait
1,822,422 A 9/1929 Richardson
1,982,281 A 11/1934 Birkenmaier
2,649,279 A * 8/1953 Jones et al. ..... 254/329
2,892,598 A 6/1959 Dudley
3,136,358 A 6/1964 Madsen
3,345,066 A * 10/1967 Izenour ..... 472/78
4,058,186 A 11/1977 Mullis
(Continued)

FOREIGN PATENT DOCUMENTS

DE 1014725 8/1957
(Continued)

OTHER PUBLICATIONS

International Search Report, PCT/US2008/083012, dated Nov. 10, 2008.

(Continued)

*Primary Examiner* — Emmanu M Marcelo
(74) *Attorney, Agent, or Firm* — Michael Best & Friedrich LLP

(57) ABSTRACT

A lift assembly system and method can include a substantially rectangular tube, a motor operably connected to first and second traction drives and a rotatable drum and structurally connected to one end of the tube, a head block fixed to the opposite end of the tube, and a plurality of loft blocks positionable at an infinite number of locations within the tube. An elongate member attached on one end to the drum can be routed through a generally horizontal path from the drum to the first and second traction drives, the head block, and the loft blocks, and then through a generally vertical path from the loft block to an attached article. The elongate member can be wound about the drum to raise the article, and unwound from the drum to lower the article. The system can further include a load-side braking mechanism. The tube can include a compressible material adapted to absorb at least a portion of a horizontal load placed on the lift system.

20 Claims, 13 Drawing Sheets

U.S. PATENT DOCUMENTS

| | | | | |
|---|---|---|---|---|
| 4,062,519 | A | 12/1977 | Jacobs | |
| 4,071,205 | A | 1/1978 | Wieschel | |
| 4,269,380 | A | 5/1981 | Shima et al. | |
| 4,303,237 | A | 12/1981 | Hoffend, Jr. et al. | |
| 4,512,117 | A | 4/1985 | Lange | |
| 4,575,050 | A | 3/1986 | Bechmann | |
| 4,606,527 | A | 8/1986 | Ziller et al. | |
| 4,767,073 | A | 8/1988 | Malzacher | |
| 5,021,954 | A | 6/1991 | Fox et al. | |
| 5,106,057 | A * | 4/1992 | Feller et al. | 254/334 |
| 5,161,104 | A | 11/1992 | Fox et al. | |
| 5,280,880 | A | 1/1994 | Ewing et al. | |
| 5,758,867 | A | 6/1998 | Arnesson | |
| 5,829,736 | A | 11/1998 | Harken | |
| 5,829,737 | A | 11/1998 | Gersemsky | |
| 5,920,476 | A | 7/1999 | Hennessey et al. | |
| 5,947,451 | A | 9/1999 | Cavanagh | |
| 5,950,953 | A | 9/1999 | Baugh et al. | |
| 6,019,353 | A | 2/2000 | Atfield | |
| 6,085,826 | A | 7/2000 | Maesaki | |
| 6,209,852 | B1 | 4/2001 | George et al. | |
| 6,385,493 | B1 * | 5/2002 | Hennessey et al. | 700/65 |
| 6,443,431 | B1 | 9/2002 | Stasny et al. | |
| 6,520,485 | B1 | 2/2003 | Soot | |
| 6,619,624 | B2 | 9/2003 | Lamphen | |
| 6,634,622 | B1 | 10/2003 | Hoffend, Jr. | |
| 6,691,986 | B2 | 2/2004 | Hoffend, Jr. | |
| 6,827,121 | B2 | 12/2004 | Park | |
| 6,889,958 | B2 | 5/2005 | Hoffend, Jr. | |
| 6,988,716 | B2 | 1/2006 | Hoffend, Jr. | |
| 6,997,442 | B2 | 2/2006 | Hoffend, Jr. | |
| 7,185,774 | B2 | 3/2007 | Colgate et al. | |
| 7,234,685 | B2 | 6/2007 | Britten | |
| 7,311,297 | B1 | 12/2007 | Bradshaw et al. | |
| 7,360,576 | B2 | 4/2008 | Lin | |
| 7,364,136 | B2 | 4/2008 | Hossler | |
| 2003/0030045 | A1 | 2/2003 | Hoffend, Jr. | |
| 2004/0098944 | A1 | 5/2004 | Hoffend, Jr. | |
| 2004/0099852 | A1 | 5/2004 | Hoffend, Jr. et al. | |
| 2004/0183060 | A1 | 9/2004 | Hoffend, Jr. | |
| 2005/0247919 | A1 | 11/2005 | Hoffend, Jr. | |
| 2006/0163548 | A1 | 7/2006 | Kochan et al. | |
| 2006/0169662 | A1 | 8/2006 | Hoffend, Jr. | |
| 2006/0284151 | A1 | 12/2006 | Hossler | |
| 2007/0001158 | A1 | 1/2007 | Hoffend, Jr. | |
| 2007/0181862 | A1 | 8/2007 | Hossler | |
| 2009/0127527 | A1 | 5/2009 | Hoffend, III | |
| 2009/0140221 | A1 | 6/2009 | Kochan et al. | |

FOREIGN PATENT DOCUMENTS

| | | |
|---|---|---|
| DE | 2710145 | 9/1978 |
| DE | 9415808.8 | 12/1994 |
| EP | 0009058 | 4/1980 |
| EP | 0457436 | 11/1991 |
| EP | 0504867 | 9/1992 |
| FR | 640143 | 10/1926 |
| FR | 2798597 | 3/2001 |
| GB | 178580 | 4/1922 |
| WO | 2006031245 | 3/2006 |

OTHER PUBLICATIONS

Written Opinion of the International Searching Authority, PCT/US2008/083012, dated Nov. 10, 2008.

Response to Communication Under Rules 161 and 162 EPC, EP 07776449.6, dated Dec. 17, 2008.

International Search Report, PCT/US2007/010377, dated Oct. 22, 2007.

Written Opinion of the International Searching Authority, PCT/US2007/010377, dated Oct. 22, 2007.

European Patent Application No. 07776449.6, Communication Pursuant to Article 94(3) EPC (Examination), Ref. No. FP-10-0510, mailed Nov. 25, 2009.

* cited by examiner

LIFT ASSEMBLY, SYSTEM, AND METHOD

CROSS-REFERENCE TO RELATED APPLICATIONS

This application is a continuation of U.S. patent application Ser. No. 11/796,781, filed Apr. 30, 2007, which claimed the benefit of U.S. Provisional Patent Application No. 60/873,389, filed Dec. 7, 2006, and U.S. Provisional Patent Application No. 60/796,362, filed on Apr. 28, 2006, the entire contents of which are incorporated by reference herein in their entirety.

FIELD OF THE INVENTION

The present invention relates to a lift assembly, system, and method. Embodiments of the present invention may be useful for raising and lowering a load in theatrical and staging environments.

BACKGROUND OF THE INVENTION

Performance venues such as theaters, arenas, concert halls, auditoriums, schools, clubs, convention centers, and television studios can employ battens or trusses to suspend, elevate, and/or lower lighting, scenery, draperies, and other equipment that can be moved relative to a stage or floor. Such battens can include pipe or joined pipe sections that form a desired length of the batten. Battens can be 50 feet or more in length. To support heavy loads or suspension points are that spaced apart, for example, 15-30 feet apart, the battens may be fabricated in various configurations, such as ladder, triangular, or box truss configurations. A number of elevating or hoisting systems are available for supporting, raising, and lowering battens and/or articles used in such venues.

Battens can be counterweighted in order to reduce the effective weight of the battens and any associated loads. As a result, the power necessary to raise and lower battens can be reduced. However, conventional counterweight systems can represent a significant cost, with respect to both equipment required and time involved to install such equipment.

Some conventional elevating or hoisting systems can employ a winch to raise and/or lower battens and other articles. Such winches can be hand-operated, motorized, and/or electrically powered. Other conventional elevating or hoisting systems can utilize a hydraulic or pneumatic device to raise and/or lower battens.

Conventional elevating or hoisting systems can include a locking device and an overload limiting device. In a sandbag counterweight system, for example, the locking device may be merely a rope tied off to a stage-mounted pin rail. The overload limit can be regulated by the size of the sandbag. In such a rigging design, however, a number of additional bags can be added to the set of rope lines, and thereby exceed the safe limit of suspension ropes and defeat the overload-limiting feature.

Elevating or hoisting systems that utilize winches can employ a locking mechanism, such as a ratchet lock mechanism. When such winches are heavily loaded, the locking capacity of the ratchet lock, or other locking mechanism, can be overcome, resulting in the suspended load being dangerously dropped. As a result, conventional lift systems can have less than effective safety mechanisms.

In addition, conventional lift systems may be configured such that a loft block, or pulley, mechanism is attached directly to an overhead building support. As a result, an undesired amount of horizontal stress can be placed on the overhead building supports to which the system and associated load are attached.

Thus, there is a need for a lift assembly that can replace traditional counterweight systems. There is a need for a lift assembly that provides effective safety mechanisms. There is a need for a lift assembly that reduces undesired horizontal stress on building supports.

SUMMARY

Some embodiments of a lift assembly and system of the present invention can include a tube, a drum, an elongate member, a drive mechanism, a head block, and a loft block. The tube can be a substantially rectangular tube having an opening in a bottom along at least a portion of the length of the tube. The tube can be connectable to an overhead structure. The drum can be located external to the tube and adapted to wind and unwind the elongate member to raise and lower an article attached to the elongate member. The drive mechanism can be structurally connected to one end of the tube externally. The drive mechanism can include a motor rotatingly connected to a first traction drive and operably connected to the drum and to a second traction drive, such that the elongate member extends along a first generally horizontal path from the drum about the first and second traction drives to the tube. The head block can be fixedly connected to an opposite end of the tube and located to redirect the elongate member from the first generally horizontal path to a second generally horizontal path back toward the drive mechanism. The loft block can be connected to the tube internally, spaced from the head block, and located to redirect the elongate member from the second generally horizontal path to a generally vertical path through the bottom opening in the tube to the attached article.

In some embodiments, the lift assembly and system can include a plurality of the loft blocks. Each loft block can be positionable and securable in place at an infinite number of locations along the length of the tube. In some embodiments, the lift assembly and system can include a braking mechanism connected to the elongate member and movable within the tube. In some embodiments, the tube can further comprise a substantially rigid, compressible material adapted to absorb at least a portion of a horizontal load placed on the lift system between the drive mechanism and the loft block. Certain embodiments of the lift assembly and system can include a plurality of the tube modules arranged in an end-to-end configuration.

Some embodiments of the present invention can include a method for raising and lowering an article utilizing embodiments of the lift assembly and system described herein. Such a method can include, for example, connecting the tube to an overhead structure, attaching an end of the elongate member to an article, winding the elongate member about the drum to raise the article, and unwinding the elongate member from the drum to lower the article.

DETAILED DESCRIPTION

Figure 1:
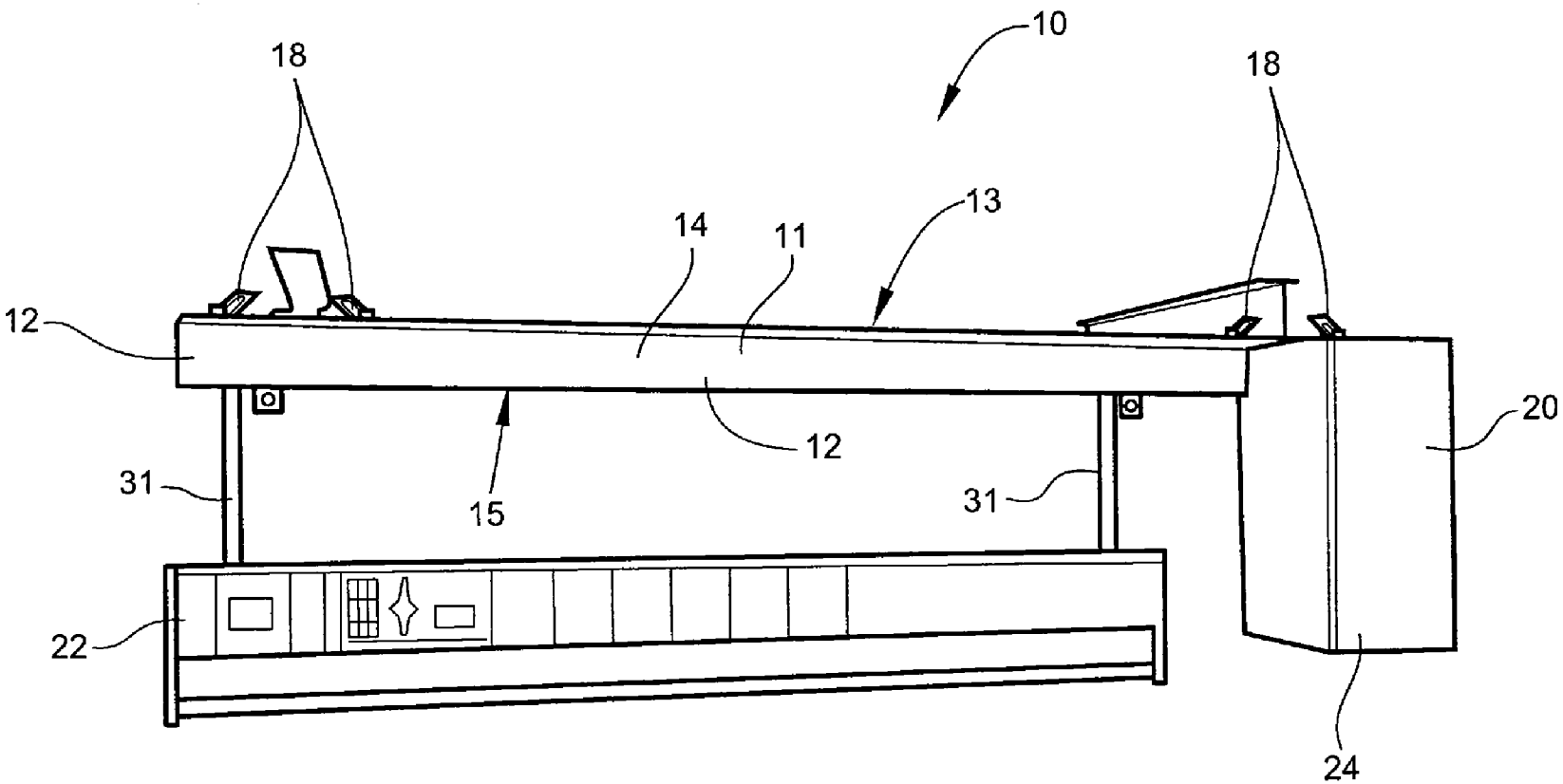
FIG. 1 is a view of a lift assembly system in an embodiment of the present invention.

Some embodiments of the present invention can provide a lift assembly, system, and/or method. FIGS. 1-13 show various aspects of such embodiments. An illustrative embodiment of a lift assembly system 10 can include a coiling apparatus, or drum 25, a first traction drive 26 operably connected to a drive mechanism 23, a second traction drive 27, a tube 11 containing one or more pulleys, for example, a head block 39 and loft blocks 32, and one or more elongate members 31, such as cables. The cables 31 can be attached to the drum 25 and configured to travel in a generally horizontal path from the drum 25 around the second traction drive 27 to and around the first traction drive 26 to the head block 39 and the loft blocks 32 inside the tube 11. From the loft blocks 32, the cables 31 can travel in a generally vertical path, that is, upward and downward between the loft blocks 32 and a surface below. An article 22, or load, can be attached to the cables 31 such that when the cables 31 are moved in the generally vertical path, the attached article 22 can be raised and/or lowered relative to the surface.

Such embodiments of a lift assembly, system, and/or method may be useful for raising and/or lowering articles 22, such as theatrical stage equipment, relative to a stage floor. Theatrical stage equipment can include equipment which is to be raised and/or lowered prior to and/or during a performance, in order to provide a desired scene effect. This equipment can include, for example, various rigging sets such as curtains, borders, screens, scene displays, props, lighting fixtures, and other equipment. The rigging sets, some of which can be generally coextensive in length with the opening of a theater stage, can have substantial mass and weight. Some embodiments of a lift assembly, system, and/or method of the present invention may be used for raising and/or lowering articles 22 and loads other than theatrical stage equipment.

In certain instances, the articles 22 to be raised and lowered can be stage equipment supported by one or more battens. A "batten" can comprise an elongated pipe, rod, or rigid strip of material. Each batten can be supported along its length by a plurality of flexible cables. Although the term "batten" is used in connection with theatrical and staging environment, including scenery, staging, lighting and sound equipment, etc., the term can encompass any load connectable to an elongate member 31, such as a windable cable.

Some embodiments of a lift assembly, system, and method of the present invention can be utilized in connection with buildings in various settings. The term "building" as used herein can encompass a structure or facility to which the lift assembly 10 is connected, such as, but not limited to, performance venues, theaters, arenas, concert halls, auditoriums, schools, clubs, educational institutions, stages, convention centers, television studios, showrooms, places of religious gathering, cruise ships, etc.

Drum

Figure 2:
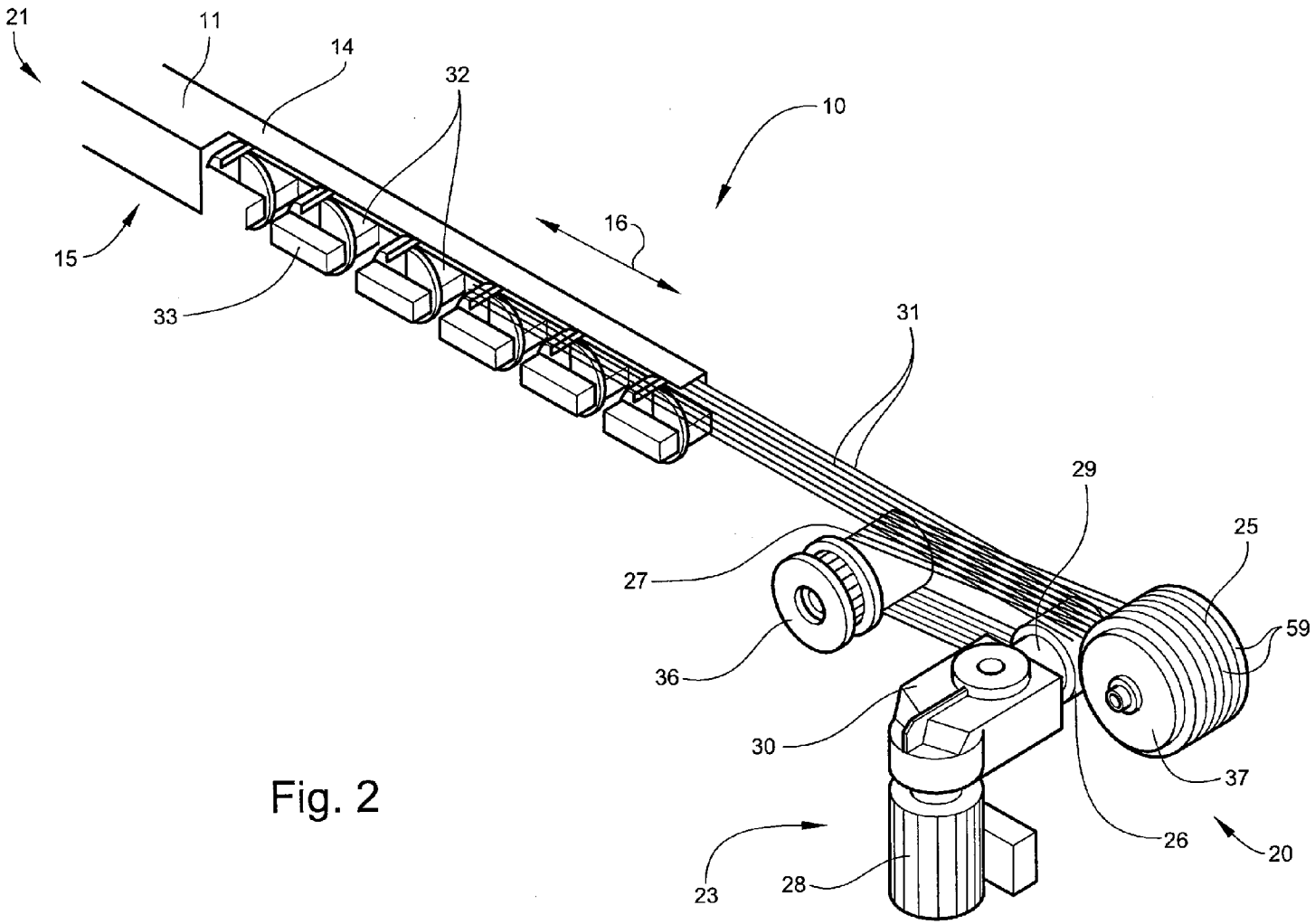
FIG. 2 is a view of a lift assembly system showing a drive mechanism and a partially cut-away view of a portion of a compression tube and the components inside the tube in an embodiment of the present invention.
Figure 3:
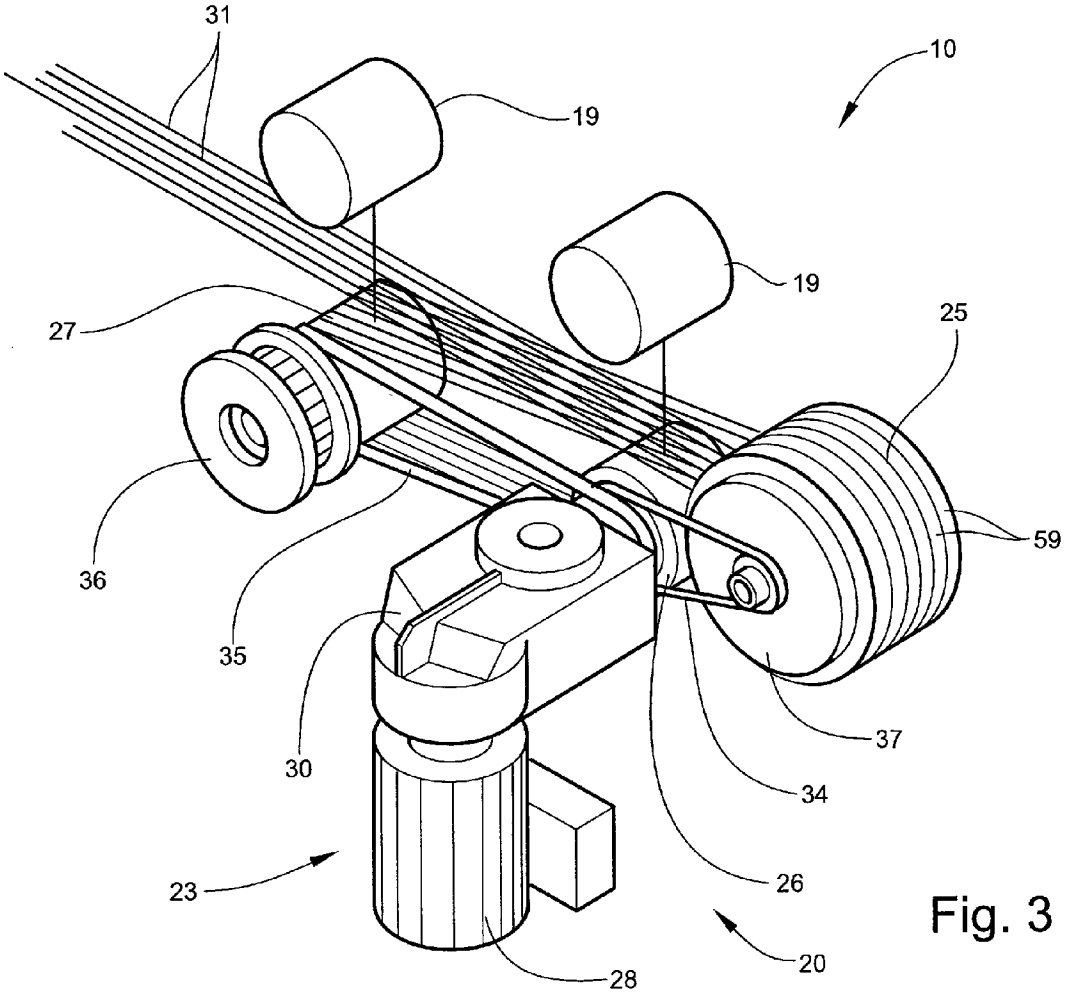
FIG. 3 is a close-up view of the drive mechanism shown in the lift assembly system in FIG. 2.
Figure 4:
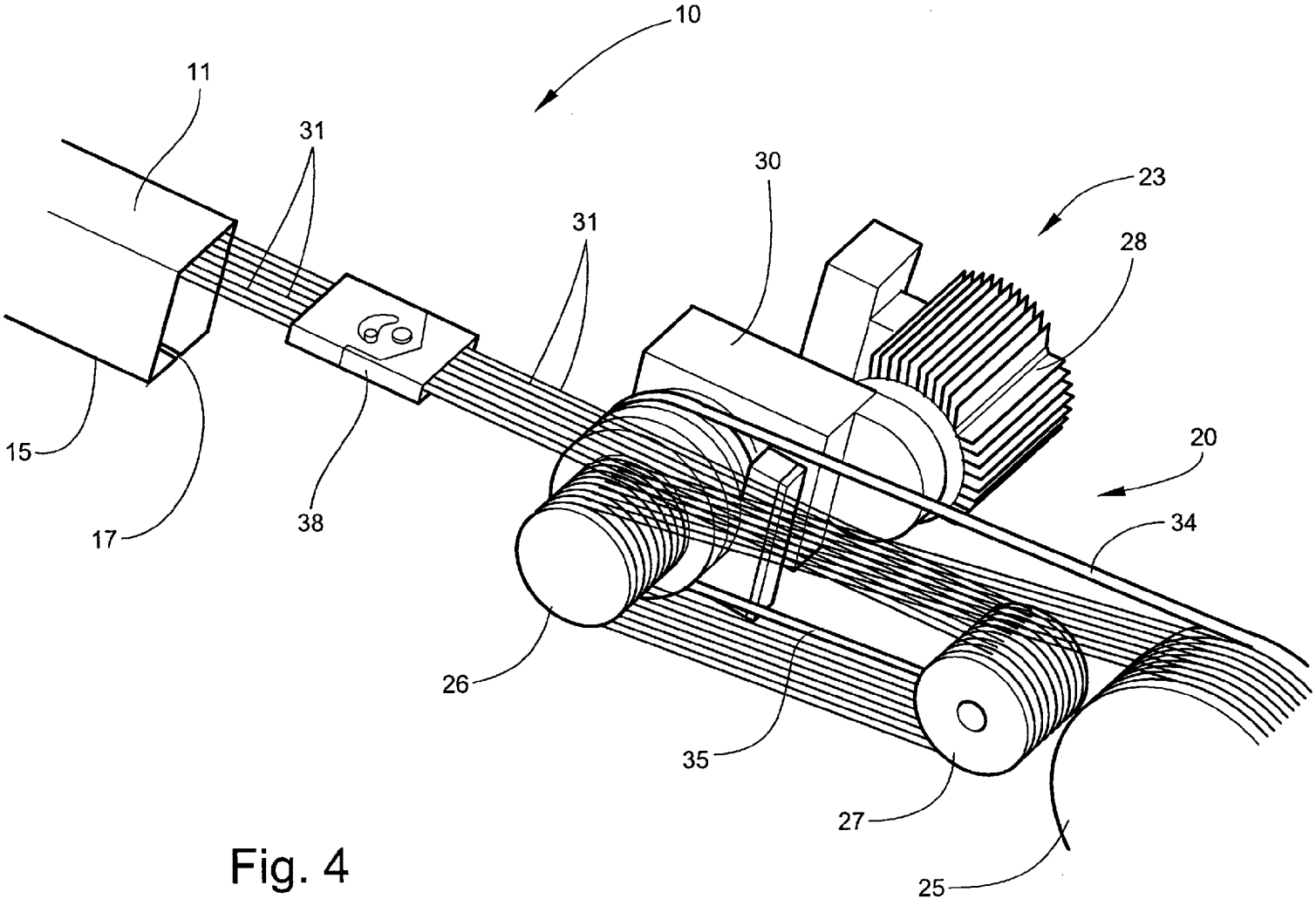
FIG. 4 is another close-up view of the drive mechanism shown in the lift assembly system in FIG. 2.
Figure 11:
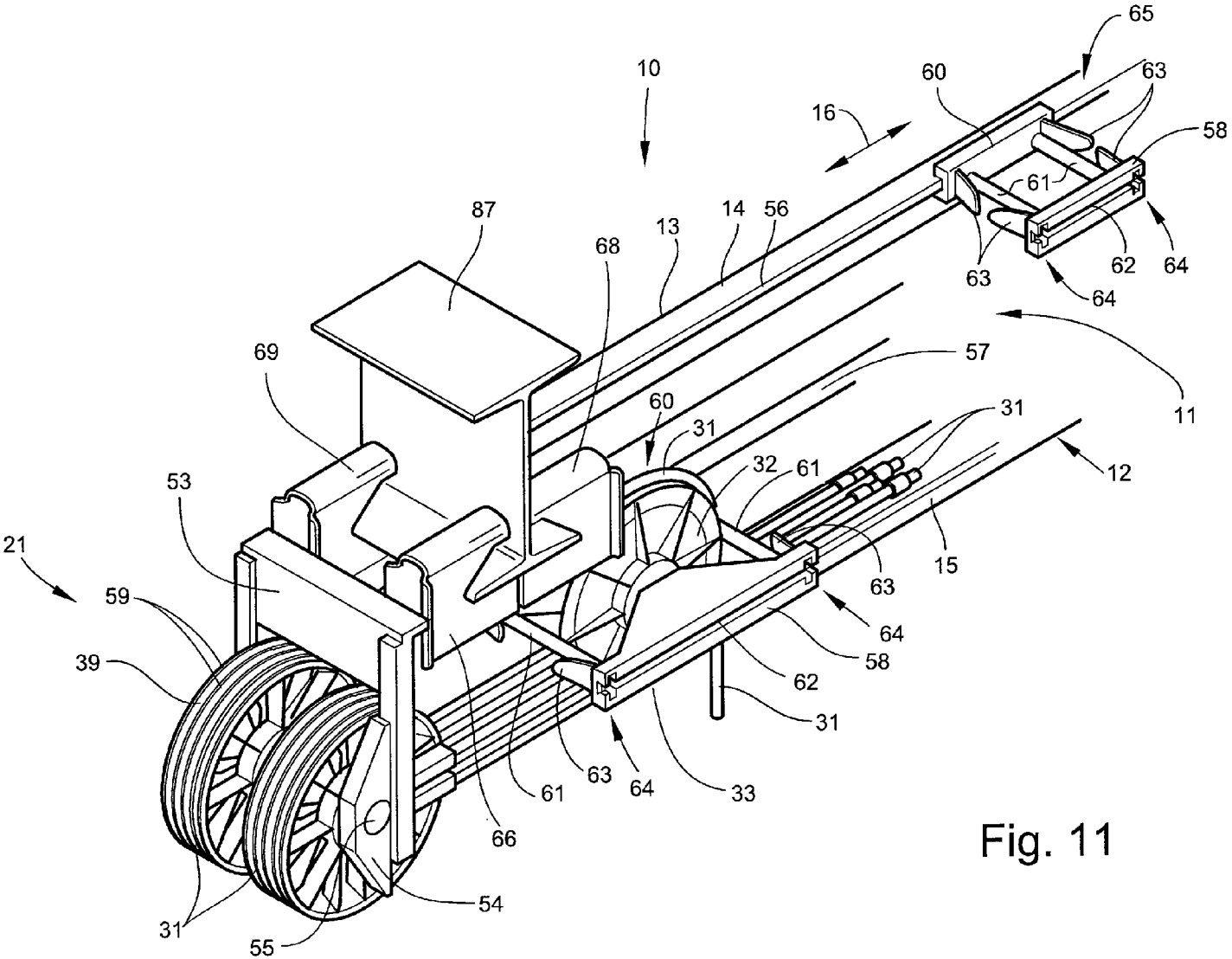
FIG. 11 is a perspective view of the head block end of a lift assembly system having the front half of the compression tube removed to show the internal components in an embodiment of the present invention.

In some embodiments of the present invention, the lift assembly system 10 can include a coiling apparatus, or drum 25, as shown in FIGS. 2-4. One end of the elongate members 31, or cables, can be securely attached to the drum 25. The drum 25 can include a series of channels 59 or contoured surface areas about which the cables 31 can be coiled, or wound, and from which the cables 31 can be uncoiled, or unwound. In some embodiments, the drum 25 can include a channel 59 or contoured surface area for each cable 31 to be wound and unwound. For example, as shown in FIGS. 3 and 11, the drum 25 can include eight cable-receiving channels 59. Each channel 59 or contoured surface area can be sized to retain a length of cable 31 sufficient to dispose the article 22 connected to the cable 31 between a fully lowered position and a fully raised position. Alternatively, the drum 25 can have a smooth surface about which the cables 31 can be wound and from which the cables 31 can be unwound in a side-by-side manner.

The drum 25 may be rotatably connected to a the tube 11 and operably connected to the motor driveshaft 29 with a linking element, such as a belt, chain, or other linking mechanism. As shown in FIG. 3, the drum 25 can be operably connected to the first traction drive 26 with a drum drive belt 34.

Traction Drives

In some embodiments of the present invention, the lift assembly system 10 can include one or more traction drives 26, 27. The traction drives 26, 27 can be rotatable such that elongate members 31 such as cables can move about the rotating surfaces of the traction drives 26, 27. The traction drives 26, 27 can include a series of channels 59 or contoured surface areas, similar to the channels 59 or contoured surface areas in the drum 25, about which the cables 31 can travel. The traction drives 26, 27 can be referred to as "sheaves." A sheave is defined for purposes herein as a wheel or disc with a grooved rim, especially one used as a pulley.

As shown in FIGS. 2-5, an embodiment of the lift assembly 10 can include two traction drives 26, 27 that are operably linked with each other and with the drum 25 with one or more chains, belts, or other linking mechanisms. For example, as shown in FIG. 3, the drum drive belt 34 can operably connect the first traction drive 26 and the drum 25 so that rotation of the first traction drive 26 causes corresponding rotation of the drum 25 in the same direction. A second traction drive belt 35 can operably connect the first traction drive 26 and the second traction drive 27 so that rotation of the first traction drive 26 causes corresponding rotation of the second traction drive 27 in the same direction. As such, the drum 25 and first and second traction drives 26, 27, respectively, can move together in a coordinated, simultaneous fashion so as to provide synchronous movement of the cables 31.

Figure 5:
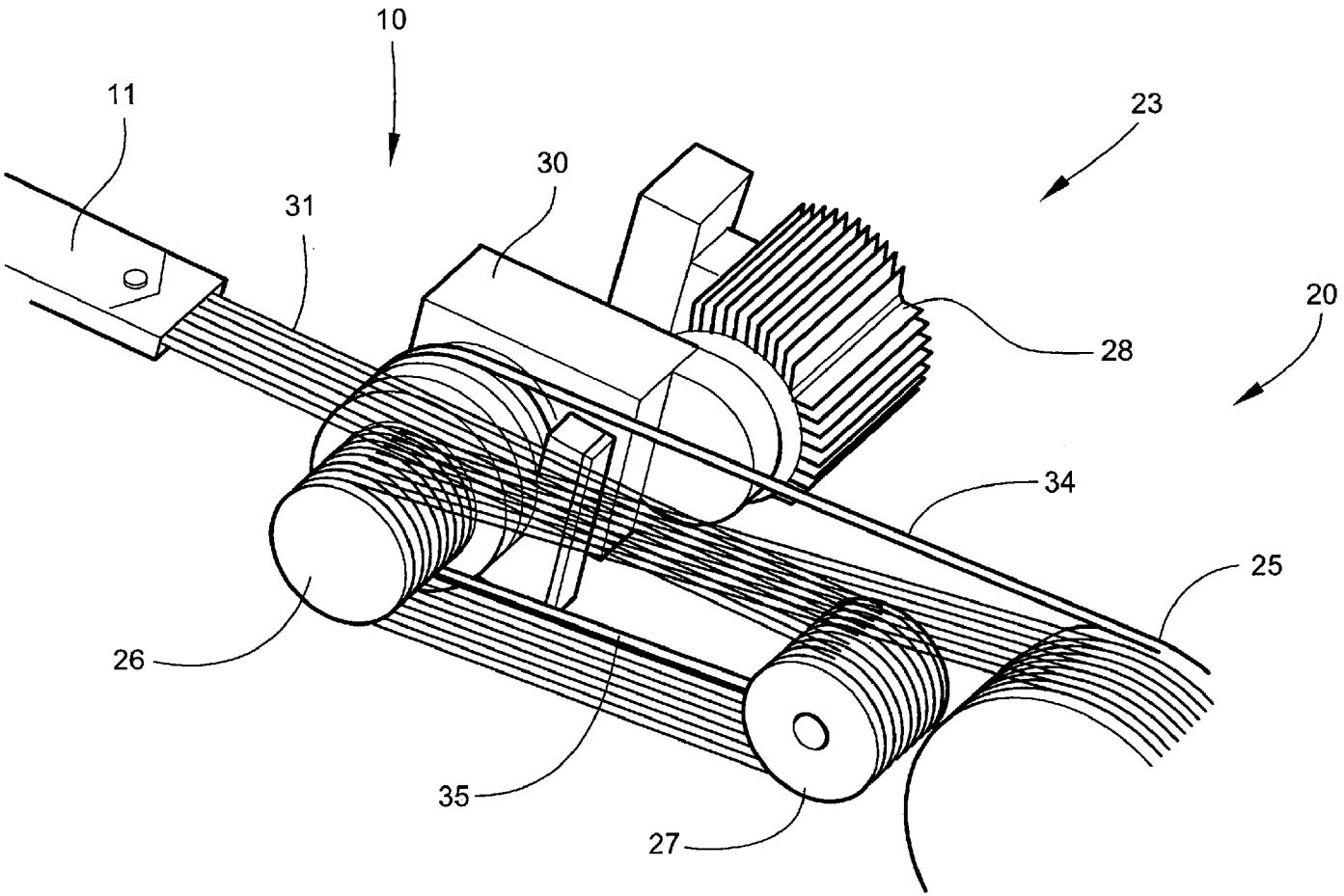
FIG. 5 is another close-up view of the drive mechanism shown in the lift assembly system in FIG. 2.

In certain embodiments, the traction drives 26, 27 can be positioned relative to each other and to the path of travel of the cables 31 such that the traction drives 26, 27 place tension on the cables 31 and thereby help to maintain the cables 31 in a desired position as the cables 31 travel along a path. For example, as shown in FIGS. 2 and 3, the first traction drive 26 can be positioned between the drum 25 and the tube 11 and the second traction drive 27 can be positioned between the first traction drive 26 and the tube 11, such that the cable 31 can extend along a generally horizontal path from the drum 25 to and about the second traction drive 27, to and about the first traction drive 26, and then to the head block 39. Alternatively, as shown in FIGS. 4 and 5, the first traction drive 26 can be positioned between the drum 25 and the tube 11 and the second traction drive 27 can be positioned between the drum 25 and the first traction drive 26, such that the cable 31 can extend along a generally horizontal path from the drum 25 to and about the first traction drive 26, to and about the second traction drive 27, and then to the head block 39. As a result, the traction drives 26, 27 can serve to keep the cables 31 in aligned positions as they travel from the drum 25 to the head block 39 and/or loft blocks 32. The use of two cooperating traction drives 26, 27 can increase the lifting (torque) capacity on the cables 31, thereby increasing the load capacity of the lift system 10. As a result, the ability of the lift assembly system 10 to safely support and move a load can be increased.

Drive Mechanism

In some embodiments of the present invention, the lift assembly system 10 can include a drive mechanism 23. The drive mechanism 23 may include a motor 28, for example, an electric motor 28. The drive mechanism 23 may further include a set of gears (not shown), which may be housed in a gear box 30, for transferring rotational motion of the motor 28 to the drive shaft 29 and in turn to the first traction drive 26. The drive mechanism 23 can be housed in a drive mechanism housing 24, as shown in FIG. 1. The motor 28 can cause rotation of the first traction drive 26 about its rotational axis. In embodiments in which the second traction drive 27 and the drum 25 are operably linked to the first traction drive 26, the motor 28 and gears can likewise cause rotation of the second traction drive 27 and the drum 25. The motor 28 may be any of a variety of high torque motors such as alternating current inverter duty motors, direct current motors, servo motors, or hydraulic motors.

The gears (not shown) in the gear box 30 can rotate the drive shaft 29, and the traction drives 26, 27 and drum 25, in a winding (raising) rotation and an unwinding (lowering) rotation. A desired gear ratio may be determined by a number of factors, including, for example, the anticipated loading, the desired lifting rates (speeds), and the capacity of the motor 28. The gears may provide a speed-reducing mechanism to reduce the rotational speed of the motor 28 to an output speed of the drive shaft 29 that is suitable for rotating the traction drives 26, 27 and drum 25.

The first traction drive 26 and the drum 25 can be operably connected with the drum drive belt 34, as described. In some embodiments, the first traction drive 26 and the drum 25 can rotate at predetermined relative speeds, or rates. When cables 31 are wound about the drum 25 such that the article 22 attached to the cables 31 is moved to its uppermost position, the cable lengths about the drum 25 create a circumference of the combined drum 25 and cables 31 that is greater than the circumference of the drum 25 alone. Thus, in certain embodiments, as the motor 28 rotates the first traction drive 26 at a first speed, due to the larger drum-cable circumference, the drum 25 can be rotated initially at a second, lower speed relative to the first rotational speed of the first traction drive 26. During an unwinding operation, the first traction drive 26 can rotate constantly at the first speed. Due to the progressively smaller drum-cable circumference during unwinding, the drum 25 can be rotated at increasing speeds relative to the initially lower second speed of the drum 25, in order for the cable 31 to move about the first traction drive 26 at the same rate as it unwinds from the drum 25. Unwinding the cables 31 from the drum 25 and about the first traction drive 26 at the same rate helps maintain a constant tension on the cables 31.

Likewise, when the cables 31 are unwound from the drum 25 such that the article 22 attached to the cables 31 is moved to its lowermost position, the cable lengths about the drum 25 create a circumference of the combined drum 25 and cables 31 that is greater than the circumference of the drum 25 alone but less than the drum-cable circumference when the cables 31 are fully wound about the drum 25. During a winding operation, the first traction drive 26 can rotate constantly at the first speed, and the drum 25 can rotate initially at the same first speed as that of the first traction drive 26. Due to the progressively larger drum-cable circumference during winding, the drum 25 can be rotated at decreasing speeds relative to the first speed in order for the cable 31 to move about the first traction drive 26 and wind about the drum 25 at the same rate. Winding the cables 31 about the first traction drive 26 and onto the drum 25 at the same rate helps maintain a constant tension on the cables 31.

In some embodiments, the drive mechanism 23 can include a tension clutch 37, as shown in FIG. 3. The tension clutch 37 can allow the drum 25 to rotate at a different speed relative to the rotational speed of the first traction drive 26 so as to accommodate the variable drum-cable circumference related to the amount of cable 31 wound about the drum 25 at particular times during winding and unwinding of the cables 31. For example, as the cables 31 are unwound from the drum 25 and the drum-cable circumference becomes smaller, the tension clutch 37 can decrease tension on the drum 25 so as to allow the drum rotational speed to increase relative to the initially lower second rotational speed of the drum 25. As the cables 31 are wound about the drum 25 and the drum-cable circumference becomes larger, the tension clutch 37 can increase tension on the drum 25 so as to allow the drum rotational speed to decrease relative to the constant speed of the first traction drive 26. In this manner, the cables 31 can be wound about and unwound from the drum 25 and about the first traction drive 26 at the same rate so as to maintain a constant tension on the cables 31.

The drive mechanism 23 arrangement can provide for control of the tension and movement of the cables 31. As such, the drive mechanism 23 can provide the advantage of allowing some embodiments of the lift assembly system 10 to be utilized without the use of counterweights. In some embodiments, the drive mechanism 23, and thereby the lift system 10, can be controlled in an automated manner, for example, by a computer 49. In certain embodiments, the drive mechanism motor 28 may be actuated by a remote control device (not shown).

In some embodiments, as shown in FIG. 3, a pressure roller 19 can be positioned adjacent each of the first and second traction drives 26, 27, respectively, to maintain a consistent pressure on each cable 31 routing about the traction drives 26, 27. For example, the pressure roller 19 can be positioned above each of the first and second traction drives 26, 27, respectively, and configured to apply positive, downward pressure on each cable 31 at the point in the cable's 31 path of travel in which it contacts the particular traction drive 26 or 27. In some situations a load attached to the cables 31 may be unevenly distributed across a plurality of cables 31 to which the load is attached. As a result, the cables 31 can be more tightly wound onto one portion of the rotating surface of the traction drives 26, 27 than onto another portion. For example, cables 31 having a heavier load portion can sink into the channels 59 in the traction drives 26, 27 more deeply as they are wound about the traction drives 26, 27 than cables 31 having a relatively lighter load portion. As uneven load pressure can cause one or more cables 31 to sink into the channel (s) 59 unevenly, the various loft block 32-cable 31 diameters can likewise be uneven, which can result in undesirable changes in the orientation, or levelness, of the attached load. By placing positive pressure with the pressure roller(s) 19 on each of the cables 31 as they route about the traction drive(s) 26, 27, evenly distributed pressure on cables 31 as they route about rotating surface of the traction drive(s) 26, 27 can be maintained. As a result, the orientation of the load can remain constant as the load is raised and/or lowered.

In certain embodiments, the drive mechanism 23 may include the pressure roller 19 in operative contact with the first traction drive 26, with the second traction drive 27, or with each of the traction drives 26, 27. The pressure roller(s) 19 may be fixed in position at a predetermined distance from the traction drives 26, 27. Alternatively, the pressure roller(s) 19 may be configured so as to be movable from one distance from the traction drive(s) 26, 27 to another distance from the traction drive(s) 26, 27. In this manner, the pressure roller(s) 19 can be adjusted to accommodate various cable diameters and/or various loads.

In some embodiments, the drive mechanism 23 can be located completely external to the tube 11 containing the loft blocks 32. Some embodiments of the lift assembly 10 can be equipped with different sizes and capacities of motors 28. As an example, a five horsepower electric motor 28 can be exchanged for a 10 horsepower motor 28 or a 15 horsepower motor 28 when greater power is desired for moving heavier objects.

As shown in FIG. 1, the lift assembly 10 can include a cover or housing 24 for the drum 25, first and second traction drives 26, 27, respectively, and other drive mechanism 23 components.

Elongate Members

Some embodiments of the lift assembly system 10 can be constructed to cooperate with at least one elongate member 31, such as a cable, or other length of material, connected at one end to the drum 25 and at the other end to the article 22 or load to be moved. In some embodiments, the number of cables 31 can be at as many as eight or more cables 31. As used herein, "cable" is defined as a steel cable, steel tape (for example, a one inch wide steel band), wire, metal, natural or synthetic rope, or other any other generally inelastic windable material suitable for raising and lowering a load.

The cables 31 can have various constructions and dimensions suitable for fitting about the drum 25, traction drives 26, 27, head block 39, and loft blocks 32 and for supporting loads attached to the cables 31. For example, the cables 31 can have multiple strands twisted together to provide increased tensile strength. In some embodiments, the cables 31 can have a diameter larger than the 3/16 inch diameter cables 31 used in conventional lift assemblies. For example, certain embodiments of a lift assembly system 10 of the present invention can accommodate a cable 31 having a ¼ inch diameter or greater. An increased cable diameter can provide increased tensile strength for supported heavy loads without breaking In alternative embodiments, the cable 31 may have a 3/16 inch diameter or smaller.

A length of cable 31 can be disposed about each channel 59 in the drum 25 sufficient to wind about the first and second traction drives, 26, 27, respectively, to extend horizontally to the head block 39 and to the loft block 32 around which it moves, and then downward to the point at which it is connected to the article 22 or load. The cable 31 can have a length sufficient to fully lower a desired article 22 or load. In some embodiments, each loft block 32 can be positioned at different intervals along the length 16 of the tube 11, and thus at a different distance from the drum 25. As a result, the cable 31 that is routed about each loft block 32 may be a different length than each other cable 31.

Compression Tube

In another aspect of the present invention, some embodiments of the lift assembly system 10 can include the compression tube 11 as shown in FIGS. 1, 2, 5, 7, and 11. The compression tube 11 can comprise a length of substantially rigid material that can be connected to an overhead building structure 87. As shown in FIG. 2, the compression tube 11 can include a plurality of loft blocks 32, or pulleys, disposed at intervals along the inside length 16 of the tube 11. Each loft block 32 can rotatingly engage one or more cables 31. The loft blocks 32 can re-direct the generally horizontal path of the cables 31 from the drum 25 and traction drives 26, 27 to a generally vertical path to the attached article(s) below the compression tube 11.

Depending upon several factors, including, for example, the dimensions and weight of the article 22 to be raised and/or lowered, the number of loft blocks 32 utilized in an embodiment of the present invention can vary. In some embodiments, for example, the lift assembly system 10 can include eight loft blocks 32 and thus eight cable drop points, as compared to some conventional lift assemblies which provide seven or fewer loft blocks 32, thus providing greater support to the article 22 and greater flexibility as to locations on the article 22 to which the cables 31 can be attached.

In some embodiments, the loft blocks 32 can be secured at an infinite number of locations along the longitudinal continuum, or length 16, of the compression tube 11, thus providing flexibility as to locations on the article 22 to which the cables 31 can be attached. In some embodiments, each loft block 32 can be connected to a loft block slider 33 having a locking mechanism 64. The loft block sliders 33 and connected loft blocks 32 can be moved for positioning at a particular location along the length 16 of the compression tube 11. In certain embodiments, the compression tube 11 can include a means for engaging the loft blocks 32. For example, the means for engaging the loft blocks 32 can include a rail 57 extending outwardly into the interior of the tube 11. Each of the loft block sliders 33 can have a groove 62 along its length adopted to slidingly engage the tube rail 57. Alternatively, the means for engaging the loft blocks 32 can include a channel in the length 16 of the opposing walls of the tube 11. Each of the loft block sliders 33 can have an arm extending outwardly from each side of the loft block sliders 33 that can slidingly engage the channels along the tube 11. In such configurations, the loft block sliders 33 and connected loft blocks 32 can be positioned at a substantially infinite number of locations along the length 16 of the tube 11. Once the loft block 32 is in a desired position along the length 16 of the tube 11, the locking mechanism 64 can be actuated to secure the loft block 32 in that position.

In some embodiments, the lift system 10 can include the head block 39 secured within the compression tube 11. In certain embodiments, the head block 39 can be secured at the head block end 21 of the tube 11 opposite the drive end 20 to which the drive mechanism 23 is attached. The head block 39 can be located to redirect the elongate member 31, or cable, from a first generally horizontal path from the drive mechanism 23 to a second generally horizontal path to the loft blocks 32 back in the direction of the drive mechanism 23. The head block 39 can include channels 59 for aligning and directing each of a plurality of the cables 31. As shown in FIG. 11, certain embodiments of the head block 39 can include a bifurcated rotating surface such that the cables 31 can be spaced apart into two groups so as to provide a space in the center along the length 16 of the tube 11 for locating the loft blocks 32. In such a configuration, one of the centermost cables 31 on one side of the bifurcated head block 39 can be routed to the loft block 32 nearest to the head block 39, so as to decrease the fleet angle of the cable 31 between the head block 39 and the loft block 32. The other centermost cable 31 (on the other side of the bifurcated head block 39) can be routed to the loft block 32 second nearest to the head block 39. The other cables 31 can then be alternatingly routed to loft blocks 32 subsequently farther from the head block 39. Such a configuration can provide for optimal fleet angles of the cables 31 and an even distribution of the load attached to the cables 31.

The compression tube 11 can include an opening 17 in the bottom 15 of the tube 11 along at least a portion of the length 16 of the tube 11. The cables 31 that are routed about the loft blocks 32 can be routed downward through the opening 17 for movement upward and downward to raise and lower the attached article 22.

Figure 12:
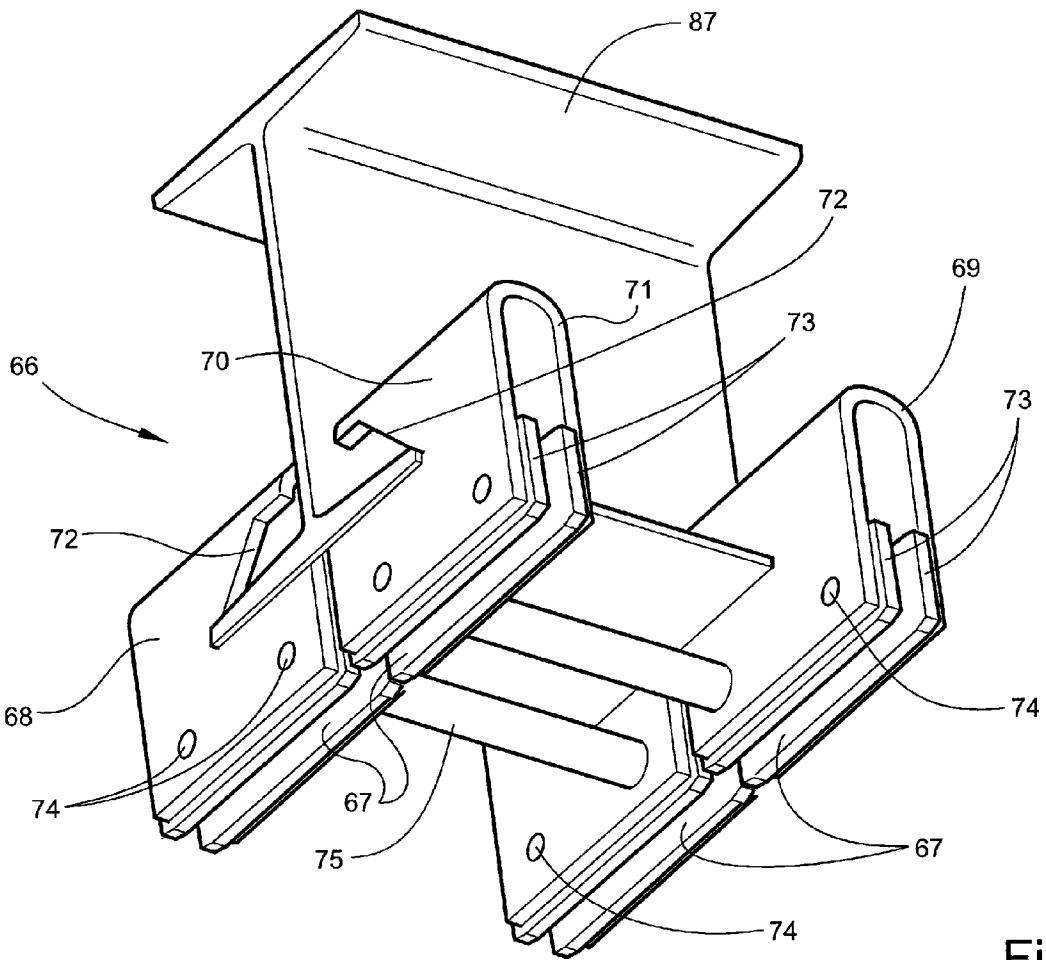
FIG. 12 is a close-up perspective view of the tube overhead connector shown in the embodiment in FIG. 11.

In some embodiments, for example, as shown in FIGS. 1 and 12, the compression tube 11 can include a connecting mechanism disposed on the top 14 of the tube 11 for connecting the tube 11 to an overhead structure 87, such as a building support beam. The connecting mechanism can comprise connector arms 18 that can be movable toward and away from each other. The connecting mechanism can include a tightening mechanism, such as a biasing mechanism, for releasably securing the connecting mechanism about the structure 87. For example, the tightening mechanism can include a threaded rod threaded through openings in each of the connector arms 18 that can be rotated so as to move the arms 18 closer to each other and about the overhead structure 87. FIG. 12 illustrates another embodiment of a tube overhead connector mechanism, described herein. The tube 11 may be connected to the overhead support structure 87 in other manners and utilizing other connecting mechanisms.

Some embodiments of the lift assembly system 10 can include a single primary compression tube 11 unit having a predetermined length. Such a primary compression tube 11 unit can be made in any desired length, for example 20 feet. If a stage, or proscenium, opening is for example, 40 feet across, two 20-foot compression tubes 11 can be installed end-to-end to provide a means for raising and lowering an article, such as a curtain, across the entire opening.

In other embodiments, the lift assembly system 10 can include a primary compression tube 11 unit and one or more extension units of the compression tube 11. In such embodiments, the extension tube 11 unit(s) can include a desired number of loft blocks 32, and can be installed end-to-end with the primary tube 11 unit to provide a length of compression tube 11 having various desired lengths. In this arrangement, the lift assembly system 10 can include a single drive mechanism 23 at one end of the primary tube 11 unit. The cables 31 to be routed through the bottom 15 of the extension tube 11 unit can be routed from the single drive mechanism 23 on the drive end 20 of the primary tube 11 through the opposite end of the primary tube 11, to the head block 39, if included, and to the loft blocks 32 in the extension tube 11. In this manner, the lift assembly system 10 can include various lengths of the compression tube 11 and various numbers of the loft blocks 32 for routing a corresponding number of the cables 31 to the article 22 to be moved. For example, one compression tube 11 may include eight loft blocks 32, and two end-to-end compression tubes 11 may contain 16 loft blocks 32. The compression tube 11 and/or extensions can be made in standardized lengths for modular use, for example, in lengths of 20 feet, 10 feet, and/or five feet. Alternatively, compression tubes 11 and/or extensions can be manufactured in customized lengths.

The compression tube 11 can be made in various manners. In one embodiment, the tube 11 can be extruded using a material such as aluminum, steel, an alloy, or other material. The compression tube 11 can comprise any material that is sufficiently strong to support the components contained inside the tube 11 and the load placed on the loft blocks 32 from the article 22 attached to the cables 31. In some embodiments, the material can be a lightweight material so as to reduce the overall weight of the lift assembly system 10. In other embodiments, the compression tube 11 can be molded from such materials.

In another aspect of the present invention, the configuration of the compression tube 11 in combination with the drive mechanism 23 can decrease or eliminate substantially all of the horizontal load stress on a ceiling and/or roof structure to which the lift assembly system 10 is mounted. In conventional lift systems, the drive mechanism 23 and the loft blocks 32 are often mounted to physically separate structures in a building, for example, different overhead beams. As a result, a load being moved by the cables 31 can place a horizontal stress between the overhead structural building supports to which the drive mechanism 23 is attached and the supports to which the loft blocks 32 are attached. Such horizontal stress between building support structures may cause loosening or weakening of those support structures and thus be undesirable. In some embodiments of the present invention, as shown in FIG. 1, the compression tube 11 (to which the loft blocks 32 are attached) and the drive mechanism 23 can be physically, or structurally, connected or integrated, for example, by welding or otherwise fastening together. In this manner, the horizontal stress between the drive mechanism 23 and the loft blocks 32 can be absorbed by the structure of the lift assembly 10, rather than being displaced onto building support structures to which separate components of the lift assembly 10 are attached.

In some embodiments, the compression tube 11 can be constructed of a substantially rigid material, for example, aluminum, steel, an alloy, or other material. The tube 11 may be adapted to absorb some of the horizontal load placed on the attached loft blocks 32, by sliding, or "floating," along the longitudinal axis, or length 16 of the tube 11. As horizontal stress is placed on the tube 11 by pressure on the cables 31 between the drive mechanism 23 and a load attached to the cables 31, the compression tube 11 can absorb at least a portion of that horizontal stress by "compressing," or moving slightly, for example, one to two inches, in the horizontal direction between the overhead support structures 87 to which it is attached. As described herein, the tube 11 may be fixedly attached at one point of contact on the tube 11 to one overhead support structure 87, and the tube can be slidably connected at one or more other points of contact to other overhead support structure(s) 87. In this manner, the compression tube 11 can compress horizontally and thereby absorb horizontal stress. As a result, the horizontal load stress on individual building supports experienced in conventional lift assemblies can be substantially decreased or eliminated in embodiments of the lift system 10 of the present invention.

A plurality of the compression tubes 11 containing a plurality of the loft blocks 32 and the cables 31 can be engaged with multiple overhead support structures 87 such that adjacent compression tubes 11 abut each other along a longitudinal dimension. As a result, multiple compression tubes 11 installed in an abutting relation can contact each other and cooperate to absorb, and thus decrease, the horizontal load on the overhead structure 87, thereby reducing any relative movement between the overhead structures 87.

In certain embodiments, the lift assembly system 10 can be supported as a free-standing unit. As an example, the lift assembly system 10 can be supported on each end 20, 21 with vertical posts that are independently secured in position. For example, vertical posts can be driven into the ground, set in concrete, or otherwise supported from the bottom. In this manner, an embodiment of the lift assembly system 10 can be used in settings without the need for an overhead support structure 87 such as the roof of a building.

Cable Belt

Figure 6:
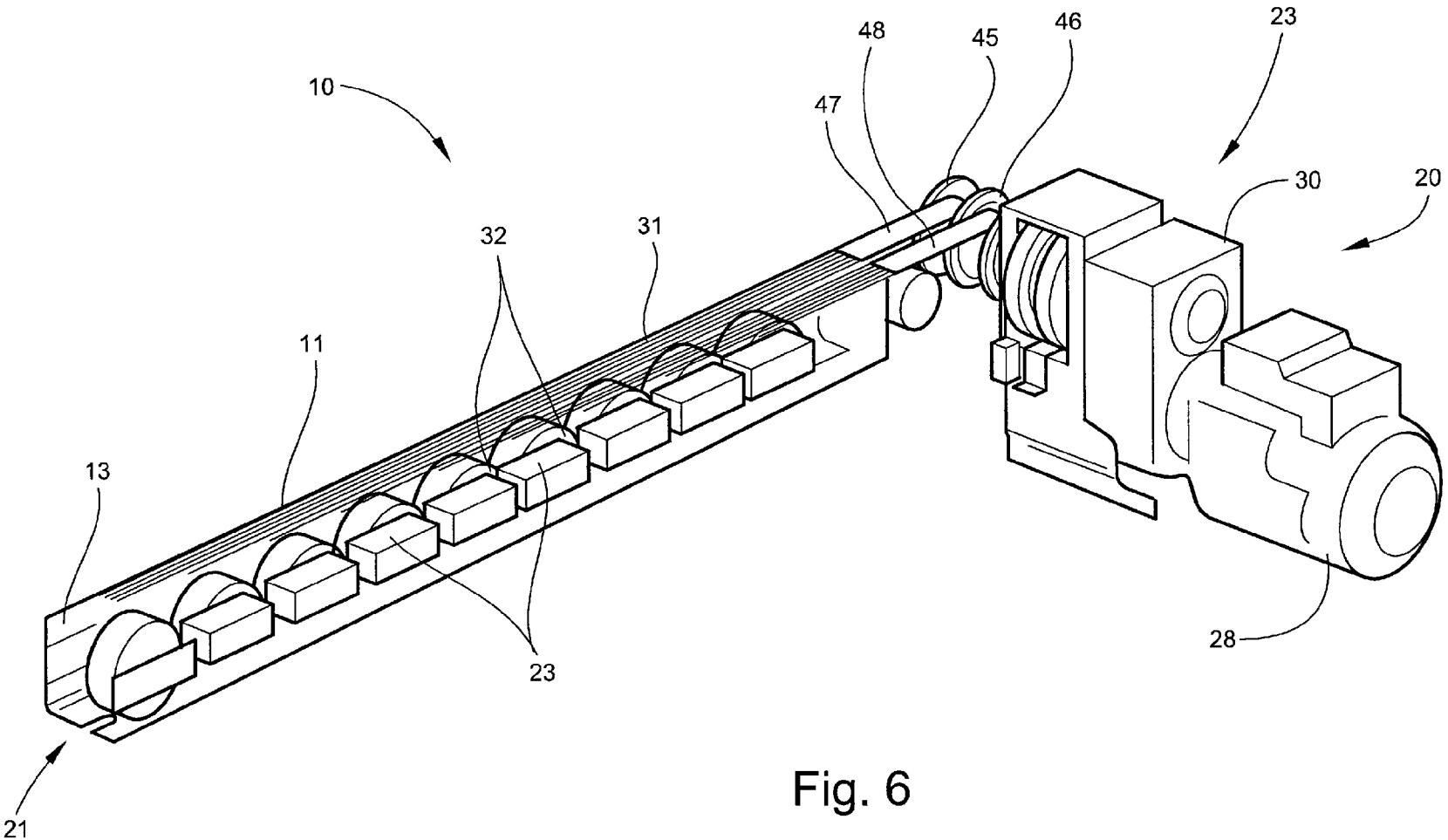
FIG. 6 is a view of a lift assembly system having two drums and two cable belts in another embodiment of the present invention. A portion of the tube has been removed to show components inside the tube.
Figure 7:
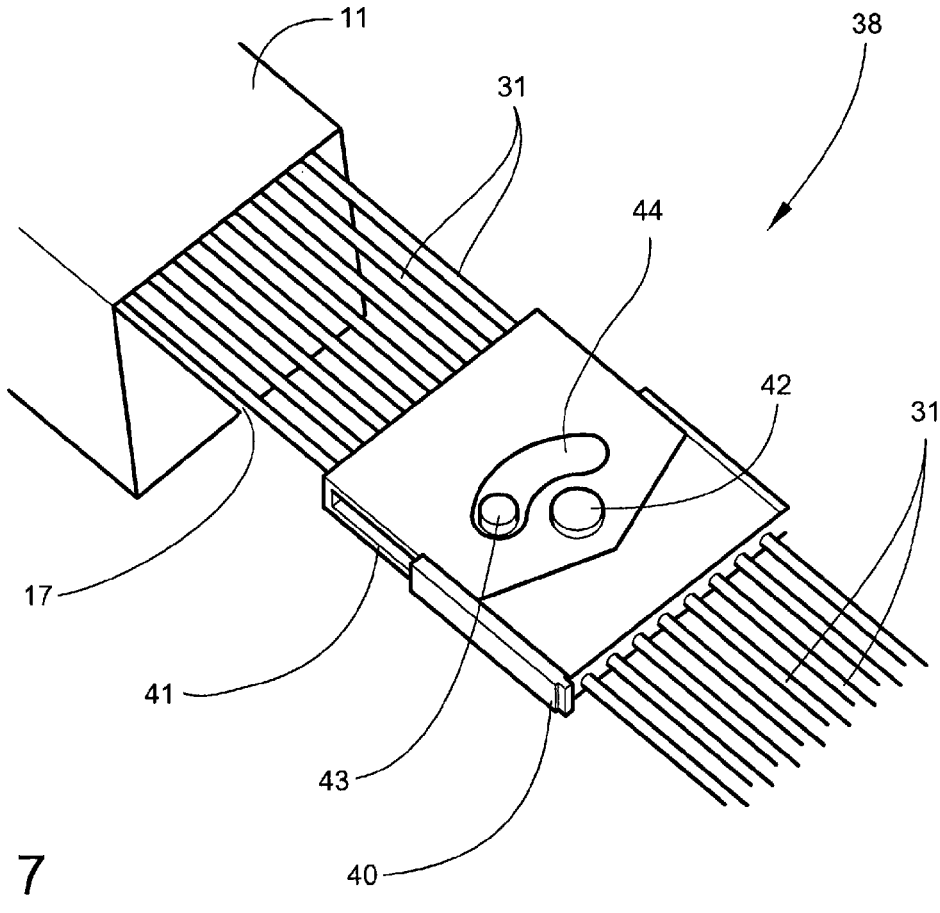
FIG. 7 is a perspective view of a cable connector in an embodiment of the present invention.
Figure 8:
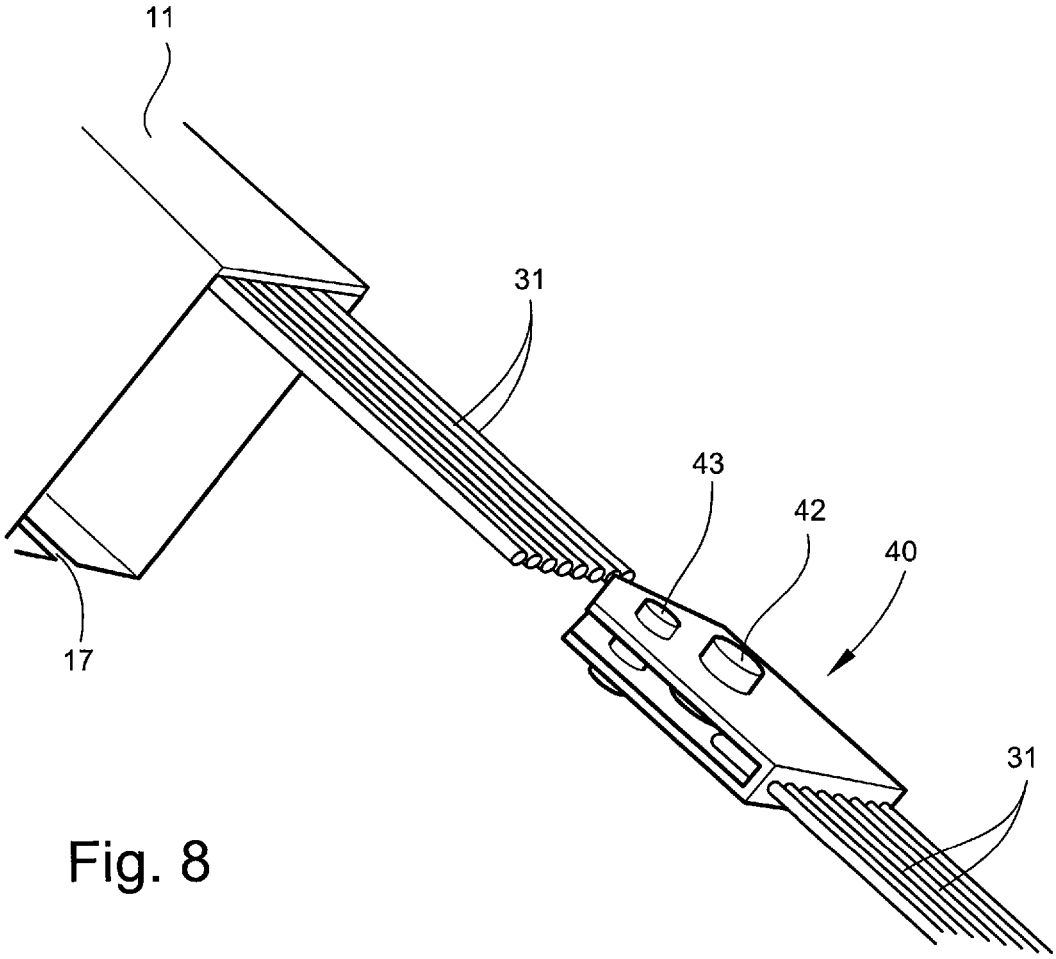
FIG. 8 is a perspective view of a portion of the cable connector shown in FIG. 7.
Figure 9:
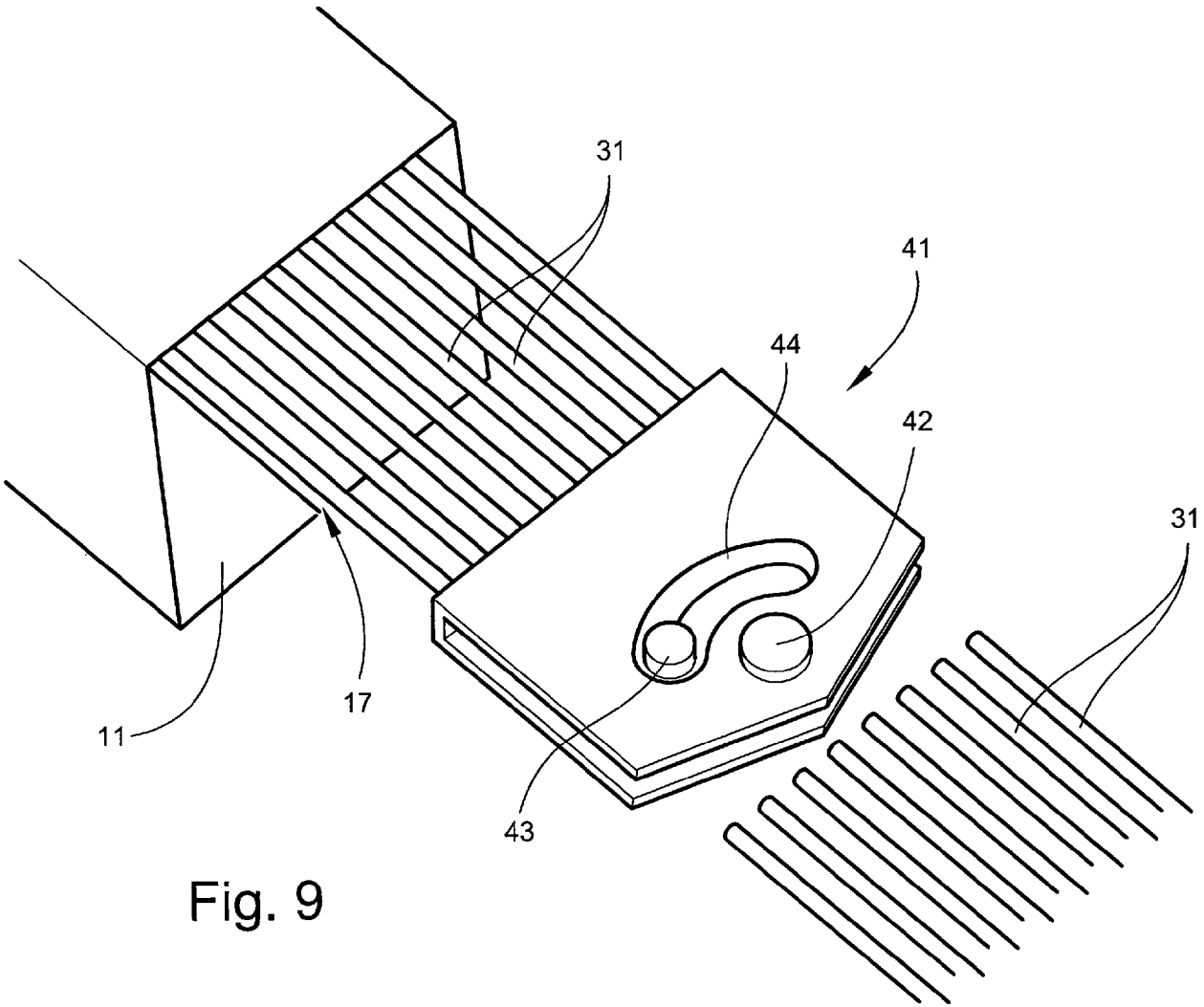
FIG. 9 is a perspective view of another portion of the cable connector shown in FIG. 7.

In an alternative embodiment, as shown in FIG. 6, the lift assembly system 10 can include a first drum 45 and a second drum 46 (or bifurcated portions of the drum 25), each drum 45, 46 being axially aligned with and operably connected to the drive shaft 29 of the drive mechanism 23. A first cable belt 47 can be attached to the first drum 45, and a second cable belt 48 can be attached to the second drum 46. The first and second cable belts 47, 48, respectively, can comprise various materials, for example, a windable steel tape. The cable belts 47, 48 can be wound about and unwound from the respective drums 45, 46. The cable belts 47, 48, or tapes, can each have a width corresponding to the width of a plurality of cables 31. A plurality of the cables 31, for example, eight cables 31, can be attached to the distal end of each of the first and second cable belts 47, 48, respectively. A plurality of cables 31 can be attached to the respective cable belts 47, 48 in various manners. One example of a means for connecting the cables 31 to the cable belts 47, 48 is the cable connector 38, as shown in FIGS. 7-9.

In such an embodiment, the head block 39 can be positioned inside the head block end 21 of the compression tube 11 opposite the drive mechanism 23. The first and second cable belts 47, 48, respectively, can move through at least a portion of the length 16 of the compression tube 11 to near the head block 39. Each of the individual cables 31 can be routed around the head block 39 and then to one of the loft blocks 32 along the length 16 of the compression tube 11.

Braking Mechanism

In another aspect of the present invention, some embodiments of the lift assembly system 10 may include a braking mechanism 36. The braking mechanism 36 can be an overspeed braking system. As shown in FIGS. 2 and 3, the brake 36 can be a "load-side" overspeed brake. That is, the brake 36 can be attached to a lift assembly 10 component other than the motor 28. In this configuration, should the motor 28 and/or gears controlling speed of cable movement fail, the lift assembly system 10 can provide a braking mechanism 36 separate from operation of the drive mechanism 23 for preventing free fall of a load attached to the cables 31. In this manner, the load-side brake 36 can provide redundancy relative to the power-train components for controlling downward movement, for example, slowing or stopping, of a load attached to the cables 31.

Conventional lift assemblies often used "motor-side" brakes, which can overheat with repeated cycles of moving a load upward and downward in quick succession. An advantage of using a "load-side" braking mechanism 36 as in some embodiments of the present invention is that such overheating related to repetitive movements of the lift mechanism can be avoided.

In some embodiments, the overspeed brake can be a "Weston" type brake, for example, as described in U.S. Pat. No. 4,009,770 to Schreyer or in U.S. Pat. No. 6,889,958 to Hoffend, Jr. In other embodiments, the braking mechanism 36 can include mechanical, electrical, pneumatic, hydraulic, and/or clutch components for the slowing and/or stopping of the free-fall of a load.

In another embodiment, the braking mechanism 36 can comprise a flexible arm (not shown), such as a piece of flexible steel or aluminum, connected to the cables 31. The flexible arm can be similar to a pawl-type arm. Tension on the cables 31 from an attached load can bias the flexible arm toward the bottom 15 or a side 12, 13 of the compression tube 11. When tension on the cables 31 is released, for example, in the event that the drive train components fail, the biasing force on the flexible arm is removed and the arm can flex and spring upward or sideward into engagement with a portion of the compression tube 11, such as the top 14 of the tube 11 or the side 12, 13 of the tube 11 opposite the biased position of the flexible arm. The top 14 or side 12, 13 of the compression tube 11 interior into which the flexible arm can spring into engagement can include a series of angled teeth similar to a ratchet configuration that can further engage the flexible arm. In this way, the cables 31 attached to the flexible arm can be engaged with a surface in the interior of the compression tube 11 and thereby stop free-fall of the cables 31 and attached load. In an embodiment, a shock absorbing material can be placed between the arm-engaging surface and the interior surface of the compression tube 11 to help reduce undesirable stress on the tube 11 in the event that the flexible arm suddenly engages the arm-engaging surface during a free-fall of a load attached to the cables 31.

In another embodiment, the load-side braking mechanism 36 can be connected to the elongate member 31, for example, between a cable belt 47, 48 and a plurality of cables 31, and movable within the tube 11. As shown in the embodiment in FIG. 12, the braking mechanism 36 can include a pair of brake cables 76 extending the length 16 of the tube 11 and secured to each end of the tube 11. A pair of spaced-apart plates 77 having grooves 78 in internal faces of the plates 77 can be configured for sliding about the pair of brake cables 76. A brake assembly 79 disposed between the plates 77 can comprise a pivot structure 80 and a rocker arm 81 at the connection with the elongate member 31. When tension on the elongate member 31 exerted by the drive mechanism 23 decreases below a preset threshold, the pivot structure 80 can pivot 86 so that the rocker arm 81 engages the brake cables 76, thereby stopping movement of the elongate member 31.

In another embodiment of a braking mechanism 36, a braking member (not shown) can be attached to the outside of each of the outer cables in a plurality of the cables 31. The two braking members can be attached to the cables 31 such that the braking members are held in place at a distance from the sides of the compression tube 11 with the tension on the cables 31 exerted by an attached load. The braking members can be arranged at a diagonal, such as in a "V" pattern, relative to the longitudinal axis, or length 16, of the tube 11. When load-induced tension on the cables 31 is released, such as during the free-fall of the cables 31 and attached load, the braking members can move apart and into braking contact with the sides 12, 13 of the compression tube 11. The sides 12, 13 of the compression tube 11 and/or the sides of the braking members facing the sides 12, 13 of the tube 11 can include a brake pad type of material to provide a friction interface for slowing the braking members to a stop when the braking members contact the sides 12, 13 of the tube 11. In this way, the cables 31 attached to the braking members can be engaged with a surface in the interior of the compression tube 11 and thereby stop free-fall of the cables 31 and attached load.

In another embodiment of the lift assembly system 10, the braking mechanism 36 can include the cable connector 38. For example, as shown in FIGS. 7-9, the cable connector 38 can include two portions, a first portion (or male portion) 40 which fits within at least a part of a second portion (female portion) 41. The two portions 40, 41 of the cable connector 38 can be secured to each other with a fastener 42, for example, a screw, through overlapping portions of the male and female portions 40, 41, respectively, of the connector 38. The two portions 40, 41 of the cable connector 38 can be fastened together such that each portion can swivel, or pivot, within a limited span relative to the other portion 40, 41. The male portion 40 can include a peg 43 extending perpendicularly through an arcuate opening 44 in the female portion 41. The combination of the peg 43 and arcuate opening 44 can serve to limit the extent of pivoting, or swiveling, between the male and female portions 40, 41, respectively, of the connector 38. The cable connector 38 can be referred to as a "clew."

The cable connector 38, or "clew," can be adapted to be inserted in the lengths of the cables 31 such that the cable connector 38 can connect one end of a plurality of the cables 31 to another end of the plurality of the cables 31. That is, each of the cables 31 can be divided, or cut, into two separate portions. Each of the divided ends of the cables 31 can be secured to one of the portions of the cable connector 38. The cable connector 38 can travel along the path of travel of the cables 31 within the compression tube 11. In the event that one of the plurality of cables 31 experiences a loss of tension due to, for example, becoming disconnected from a load or from breaking, the lateral tension on the cable connector 38 from the remaining cables 31 can cause the cable connector portions 40, 41 to pivot, or swivel, relative to each other. When the cable connector portions 40, 41 swivel to one side, the side of the cable connector 38 can contact the side 12, 13 of the compression tube 11. In this way, movement of the cables 31 and attached load can be slowed so as to prevent undesired downward movement of the load. In certain embodiments, the sides of the cable connector 38 and/or the sides 12, 13 of the compression tube 11 can include a brake pad type of material to provide a friction interface for slowing and/or stopping the cables when the cable connector 38 contacts the side 12, 13 of the tube 11.

Sensor

In another aspect of the present invention, some embodiments of the lift assembly system 10 can include a safety mechanism for slowing and/or stopping downward movement of the cables 31 and attached article(s) 22 upon detection of an obstacle in an intended path of travel.

In such an embodiment, the safety mechanism can include a sensor (not shown) attached to cable(s) that can be adapted to sense if an object other than an intended surface (such as a floor or the ground) is underneath it. The motor 28 can be adapted to alter movement, for example, interrupt, stop, and/or reverse movement, of the cables 31, and the attached article (s) 22, in response to a signal from the sensor indicating presence of an undesired object in the intended path of travel. For example, if a person walks underneath a descending article 22 attached to the cables 31, the sensor can detect the presence of the person and signal the motor 28 that an object is in the path of travel of the article 22. The motor 28 can then interrupt, stop, and/or reverse movement of the cables 31, and the attached article 22. The motor 28 can be programmed so that once the object obstructing the article's path of movement is removed from the path of movement, for example, when a person moves from underneath the descending article 22, the motor 28 can be automatically actuated to resume downward movement of the article 22.

The sensor can be a laser, ultrasonic, infrared, photoelectric, mechanical, proximity, or other type of sensor capable of sensing presence and/or absence of an object in an intended path of travel. In some embodiments, the sensor may be connected to the article 22, to a batten, or to one or more cables 31. In certain embodiments, the sensor can be sized and colored to reduce visibility by a viewing audience.

The sensor may be operably connected to a controller, such as the computer 49, by a wire or wireless connection. The signal sent by the sensor indicating an undesirable object or obstruction in the article's path of movement can be received by and processed by the computer 49. Once the computer 49 processes the signal from the sensor, the computer 49 can send a signal to alter operation of the motor 28 in a predetermined manner, such as stopping rotation of the motor 28.

Controller

In another aspect of the present invention, some embodiments of the lift assembly system 10 can include a controller for controlling the drive mechanism 23, and thereby movement of the cables 31 and attached article 22 or load. The controller can be a dedicated device or, alternatively, can include software for running on a personal computer 49, wherein control signals are generated for the lift assembly 10. In some embodiments, the controller can include an algorithm designed for safety. For example, if an obstruction is detected by a sensor, the processor may automatically slow descent of the cables 31 and attached article(s) 22 to a lower downward velocity and/or stop movement altogether.

The controller may be programmed to process signal(s) from sensor(s) attached to the cable(s) 31 and/or attached article(s) 22 to determine the distance a particular point along the length of the cable 31 and/or article 22 is from the surface (such as a floor or the ground) below the cable 31 and/or article 22. For example, one or more sensors can be placed on the ends of the cables 31 that can be adapted to sense the distance between the ends of the cables 31, and thereby the bottom of the article 22, and the floor below, and send a signal to the computer 49 indicating that distance. The computer 49 can be programmed to perform various operations in response to the cable end location signal. For example, the computer 49 can slow and/or stop movement of the cable 31 and attached article 22, change orientation of the article 22 relative to the floor or other points of reference, reverse direction of movement of the article 22 at a predetermined time following receipt of the cable end location signal, as well as other operations.

Control of the lift assembly 10, and particularly the drive mechanism 23 or motor 28 can be accomplished by a dedicated processor operably connected to the lift assembly system 10. The processor can be operably connected to the drive mechanism 23, and specifically the electric motor 28, to control a variable speed of the motor 28. The processor can be configured, or include code, to perform a number of functions, including, for example, control of the associated lift assembly 10; queuing functions; timing or duration of a particular drive state; controlling the motor 28 to locate the connected load at a predetermined location; translating a load at a specific speed (velocity); and/or controlling an acceleration to a given speed as well as a deceleration to a given speed. In an exemplary embodiment, the computer 49 processor may be configured to: (1) rotate the drum 25 at a first velocity in a first rotational direction; (2) rotate the drum 25 at a second velocity in a second, different rotational direction; (3) accelerate the drum 25 rotation in the first rotational direction; (4) accelerate the drum 25 rotation in the second rotational direction; (5) rotate the drum 25 a first amount in the first rotational direction; and/or (6) rotate the drum 25 a second amount in the second rotational direction.

Figure 10:
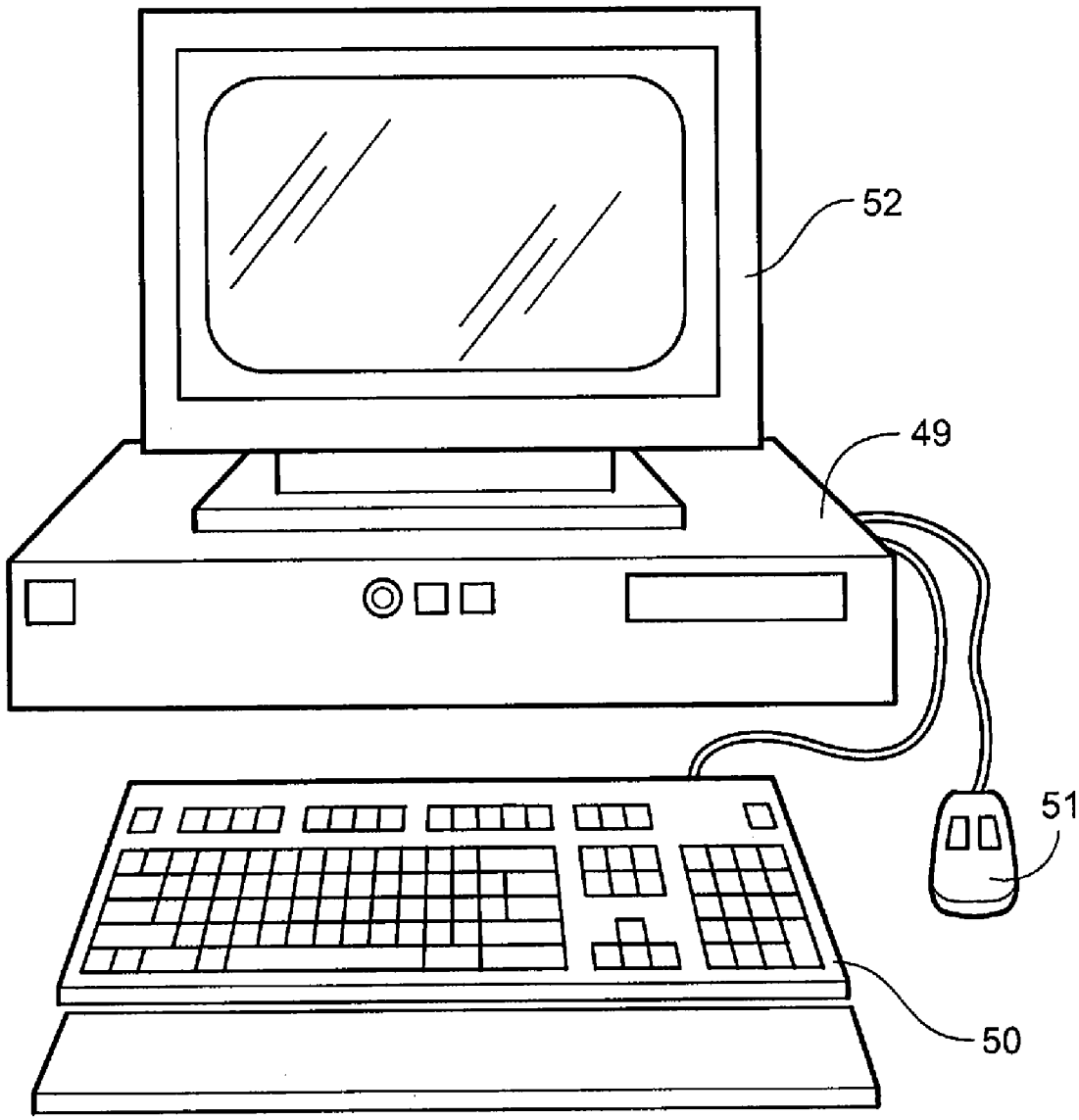
FIG. 10 is a view of a computer controller useful in an embodiment of the present invention.

In some embodiments, the computer 49, for example as shown in FIG. 10, may comprise a processor or processors (not shown). A computer-readable medium, such as a random access memory (RAM), can be coupled to the processor. The processor can execute computer-executable program instructions stored in memory, such as executing one or more computer programs for operating the lift assembly. Such processors may comprise a microprocessor, a digital signal processor (DSP), an application-specific integrated circuit (ASIC), field programmable gate arrays (FPGAs), and state machines. Such processors may further comprise programmable electronic devices such as programmable interrupt controllers (PICs), programmable logic controllers (PLCs), programmable read-only memories (PROMs), electronically programmable read-only memories (EPROMs or EEPROMs), or other similar devices.

Such processors may comprise, or may be in communication with, media, for example computer-readable media, that may store instructions. When executed by the processor, the instructions can cause the processor to perform the steps described herein as being carried out, or assisted, by a processor. Certain embodiments of computer-readable media may comprise, but are not limited to, an electronic, optical, magnetic, or other storage or transmission device capable of providing a processor with computer-readable instructions. Other examples of media comprise, but are not limited to, a floppy disk, CD-ROM, magnetic disk, memory chip, ROM, RAM, ASIC, configured processor, optical media, magnetic tape or other magnetic media, or any other medium from which a computer processor can read instructions. Instructions may be transmitted or carried to a computer using various other forms of computer-readable media, such as a router, private or public network, or other transmission device or channel. The processor, and the processing, described may be encompassed in one or more structures, and may be dispersed through one or more structures. The processor may comprise code for carrying out one or more of the methods (or parts of methods) described herein.

In another aspect of some embodiments of the present invention, the computer 49 may be programmed to send a signal to the motor 28 to change the rate of movement of the cables 31 and attached article 22 at particular points along the path of movement. For example, in certain embodiments, the computer 49 may be programmed to decelerate downward movement of the cables 31 and attached article 22 when the article 22 reaches a predetermined distance from the surface below the article 22. That is, the cables 31 and article 22 may be lowered toward the surface below at a first rate. When the article 22, such as a stage curtain, reaches a particular distance from the stage floor below, for example, two feet above the stage floor, the computer 49 may signal the motor 28 to decelerate movement to a second, slower rate of descent until the bottom of the stage curtain reaches the stage floor.

In certain embodiments, the computer 49 may be programmed to change the direction and/or rate of movement of the cables 31 and attached article(s) 22 at particular intervals. The changes in direction and/or rate of movement of the article(s) 22 can be coordinated with an artistic performance. For example, the computer 49 can be programmed to actuate the motor 28 to move a piece of background scenery, such as a depiction of the sun, upward at a slow rate from one direction to indicate rising of the sun. The computer 49 can be programmed to actuate the motor 28 at a predetermined time to then move the sun scenery rapidly downward in the opposite direction to indicate the quickly approaching nightfall. Accordingly, the computer 49 can be programmed to actuate the motor 28 to move the cables 31 and attached article(s) 22 in various directions and rates of movement for dramatic effect.

In another embodiment, the computer 49 processor may be configured to rotate the drum 25 in a direction, amount, and velocity corresponding to the direction, amount, and velocity of rotation of a drum 25 in another lift assembly. That is, the controller/processor 49 can include the ability to communicate with one or more interconnected lift assemblies 10 and control coordination of the operation of each of those lift assemblies 10. As examples, in particular theatrical productions, multiple lift assemblies 10 may be controlled by a single controller to raise and/or lower a vehicle, a platform on which performers can position themselves, or a fish tank while maintaining a substantially level water level in the tank.

As shown in FIG. 10, the controller can include a computer 49 and a computer video display 52 useful for operating a processor for controlling embodiments of the lift assembly system 10. In some embodiments, a user interface can be provided to facilitate operation of the processor and the lift assembly 10 by a user. For example, the user interface can include a laptop computer, keyboard 50, mouse 51, touch screen, computer video display terminal 52, remote control device, and/or other input device. The user interface components can allow an operator to monitor, control, override, change operational parameters, and otherwise operate each of the functions and safety features of embodiments of a single lift assembly 10 or multiple interconnected lift assemblies 10 of the present invention.

Assembly of Lift System

Some embodiments of a lift assembly system 10 of the present invention can be manufactured and/or assembled in an efficient manner. Some embodiments can include up to 75 percent fewer components as compared to conventional lift assemblies (for example, 50 parts vs. 200 parts). Fewer components can decrease the complexity of the mechanical arrangement of the lift assembly system 10. Fewer components can also substantially decrease the manufacturing cost (for example, up to 60 percent less cost) as compared to conventional lift assemblies.

Due to the streamlined footprint of the assembled tube 11 and drive mechanism housing 24, embodiments of the lift assembly system 10 of the present invention can be assembled in a substantially smaller floor space relative to that required for manufacturing conventional lift systems. In some embodiments, the assembly process can be at least partially automated. Efficiency with respect to required assembly space (for assembling fewer components) in embodiments of a lift assembly system 10 of the present invention can reduce the manufacturing costs as compared to conventional theater rigging systems.

Shipping and Installation

In another aspect of the present invention, some embodiments of the lift assembly system 10 of the present invention can be packaged for shipping to a customer for quick and easy installation. That is, the lift assembly system 10 can be packaged having all components ready for operation upon mounting to the overhead support structure 87. For example, the cables 31 can be pre-routed from the drum 25 around the two traction drives 26, 27 and around the head block 39 and the loft blocks 32 inside the compression tube 11. Once the integrated compression tube-drive mechanism system is mounted to the overhead support structure 87, the loft blocks 32 can be moved by hand (for example, by depressing the tabs 63 as shown in FIG. 11) or with a small tool into desired positions along the length 16 of the tube 11. Once in position, the loft blocks 32 can be securely fastened to the compression tube 11 and the cables 31 dropped through the longitudinal opening 17 in the tube 11 for attachment to the article 22. Such a ready-to-operate installation avoids the need to route cables 31 through their path of travel, and can be accomplished without any special tools. Installation may be accomplished by persons not having training or experience with such rigging or installation of lift systems, for example, an electrical contractor.

Some embodiments of the present invention can comprise substantially less overall size, or footprint, than conventional theater rigging systems. An overall smaller size can be advantageous for handling during shipping. For example, a conventional lift assembly may be shipped in a shipping crate that is approximately 14 feet in length. Some embodiments of a lift assembly 10 of the present invention can be shipped on a typical three foot square shipping pallet. That is, the space required for shipping an embodiment of a lift assembly 10 of the present invention can be substantially less than that required by a conventional lift assembly. As a result, an embodiment of the present invention may be loaded and unloaded from a shipping vehicle using a regular-sized forklift rather than an oversized forklift that may be required for larger conventional lift assemblies.

Some embodiments of the lift assembly can provide a modular, self-contained unit that can be readily installed in a wide variety of building configurations. Due to the decreased overall size, some embodiments of the lift assembly 10 of the present invention can be installed in almost any existing building construction or configuration. Decreased space requirements for installation in combination with fewer assembled components can result in embodiments of the present invention being installed more easily and more quickly, thus decreasing installation costs.

Figure 13:
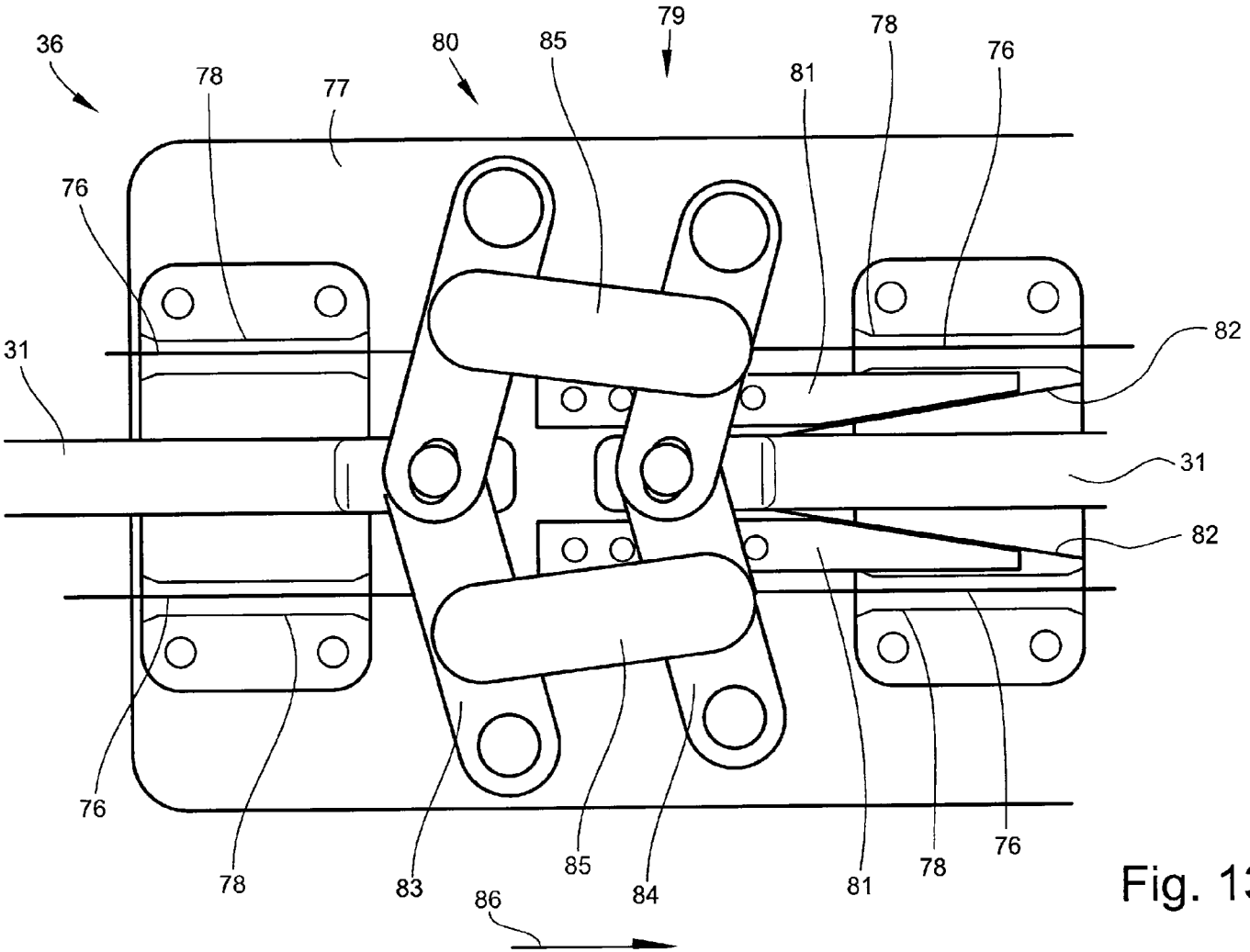
FIG. 13 is a view of a braking mechanism having one plate removed to show the internal components in an embodiment of the present invention.

FIGS. 11-13 show illustrative embodiments of aspects of the present invention. In some embodiments, the lift assembly system 10 can include a substantially rectangular tube 11 having a front and a rear C-shaped portion connected together to form a front 12, rear 13, top 14, and bottom 15 of the tube 11. In FIG. 11, the top 14 and front 12 portions of the tube 11 have been removed to show the arrangement of components inside the tube 11. The C-shaped portions of the tube 11 can be configured such that when the portions are connected together, the bottom 15 edges of the front and rear portions remain spaced apart, thereby providing the opening 17 in the bottom 15 along at least a portion of the length 16 of the tube 11. The tube 11 can be connectable to the overhead structure 87, such as a building support beam.

The lift system 10 can include the drum 25 positioned externally to the tube 11, as shown in FIGS. 2-5. The drum 25 can be adapted to wind and unwind one or more elongate members 31, such as cables, to raise and lower the article 22 attached to the elongate members 31. The lift system 10 can further include the drive mechanism 23, as shown in FIGS. 2-5, structurally connected to the drive end 20 of the tube 11 externally. The drive mechanism 23 can comprise the motor 28 rotatingly connected to the first traction drive 26 and operably connected to the drum 25 and to the second traction drive 27. In such a configuration, the elongate member 31 can extend along a first generally horizontal path from the drum 25 about the first and second traction drives 26, 27, respectively, to the tube 11.

The head block 39 can be fixedly connected to the head block end 21 of the tube 11 opposite the drive end 20. The head block 39 can rotate about a head block axle 55, which is supported on either side of the head block 39 in a head block axle support 54. A head block mount 53 can be attached to and extend from the axle support 54 on each side of the head block 39. The head block mount 53 can be rotated into alignment with a surface of the tube 11 and be fastened to the tube 11 so as to secure the head block 39 to the tube 11. The head block 39 can be located to redirect the elongate member 31 from the first generally horizontal path to a second generally horizontal path from the head block 39 back toward the drive mechanism 23.

The loft block 32 can be spaced from the head block 39 and connected to the tube 11 internally. The loft block 32 can be located to redirect the elongate member 31 from the second generally horizontal path to a generally vertical path through the bottom opening 17 in the tube 11 to the attached article 22. In some embodiments, the lift system 10 can include a plurality of the loft blocks 32. Each loft block 32 can be positioned at an infinite number of locations on the continuum along the length 16 of the tube 11.

The loft block 32 can further include the loft block slider 33 adapted to position the loft block 32 at a desired location along the length 16 of the tube 11. The loft block slider 33 can comprise a front slider arm 58 spaced apart from a rear slider arm 60, and a support bar 61 on each end of the loft block slider 33 connecting the front and rear slider arms 58, 60, respectively. A loft block axle (not shown) can be supported on one end by the front slider arm 58 and on the opposite end by the rear slider arm 60. The loft block 32 can be rotatingly attached about the loft block axle. Each of the front and rear loft block slider arms 58, 60, respectively, can include a groove 62 along the length 16 of the slider arm 58, 60. The groove 62 an be adapted to slidingly engage a respective lower front rail or lower rear rail 57 along the length 16 of the tube 11. By sliding the loft block slider groove 62 along the lower tube rails 57, the loft block 32 can be positioned at a desired location along the length 16 of the tube 11.

The loft block slider 33 can further include a locking mechanism 64 disposed on each of the front and rear slider arms 58, 60, respectively, for locking the loft block in a desired position along the length 16 of the tube 11. In the embodiment shown in FIG. 11, the loft block slider locking mechanism 64 can include a tab 63 located on each end of the front and rear slider arms 58, 60, respectively, and a biasing mechanism attached to each tab 63. When the tabs 63 are depressed, the biasing mechanism is released and the loft block slider 33 can be slid along the front and rear tube rails 57. When the tabs 63 are released, the biasing mechanism is actuated so as to lock the loft block 32 onto the front and rear tube rails 57.

In some embodiments, the lift system 10 can include a tube support slider 65, as shown in FIG. 11. The tube support slider 65 may be positioned along the length 16 of the tube 11 to provide additional front-to-rear structural support to the tube 11. For example, each of a plurality of the tube support sliders 65 may be positioned in between locations of the loft blocks 32. The tube support slider 65 can be similar to the loft block slider 33 in design and operation. The tube support slider 65 can comprise a front slider arm 58 spaced apart from a rear slider arm 60, and a support bar 61 on each end of the tube support slider 65 connecting the front and rear slider arms 58, 60, respectively. Each of the front and rear tube support slider arms 58, 60 can include a groove 62 along the length of the slider arm 58, 60. The groove 62 can be adapted to slidingly engage a respective upper front rail or upper rear rail 56 along the length 16 of the tube 11. By sliding the tube support slider groove 62 along the upper tube rails 56, the tube support slider 65 can be positioned at a desired location along the length 16 of the tube 11.

The tube support slider 65 can further include a locking mechanism 64 disposed on each of the front and rear slider arms 58, 60, respectively, for locking the tube support slider 65 in a desired position along the length 16 of the tube 11. The tube support slider locking mechanism 64 can include the tab 63 located on each end of the front and rear slider arms 58, 60, respectively, and a biasing mechanism attached to each tab 63. When the tabs 63 are depressed, the biasing mechanism is released and the tube support slider 65 can be slid along the front and rear tube rails 56. When the tabs 63 are released, the biasing mechanism is actuated so as to lock the tube support slider 65 onto the front and rear tube rails 56.

In certain embodiments, the loft block sliders 33 and the tube support sliders 65 can provide structural support to the compression tube 11 so as to help prevent the tube 11 from bowing outwardly in a perpendicular direction relative to the length 16 of the tube 11. As horizontal stress is placed on the lift system 10 between the drive mechanism 23 and the loft blocks 32 by a load attached to the cables, the tube 11 may have a tendency to bow outwardly from front 12 to back 13. Thus, the loft block sliders 33 and the tube support sliders 65 can help prevent the tube 11 from bowing outwardly in a perpendicular direction relative to the length 16 of the tube 11.

Some embodiments of the lift assembly system 10, for example, as shown in FIG. 11, can include a plurality of the tubes 11 arranged end-to-end. A plurality of the loft blocks 32 can be positioned along each of the modular tubes 11, and one of a plurality of the elongate members 31 can be routed about each of the loft blocks 32.

FIG. 11 shows the plurality of elongate members 31, or cables, coming from the drive mechanism 23 unattached in the bottom 15 of the tube 11. In some embodiments, the plurality of cables 11 can be attached to the cable belt 47, 48, for example, as shown in FIG. 6. The cable belt 47, 48 can have a width substantially equal to a width of the drum 25, and can be windably attached to the drum 25. As illustrated in FIG. 11, the head block 39 can include a series of channels 59 for aligning and directing each of a plurality of the cables 31. The drum 25 and the first and second traction drives 26, 27, respectively, can also each include a plurality of channels 59 in their respective surfaces, each channel 59 being configured to align and direct one of a plurality of the cables 31 along its path. Certain embodiments of the head block 39, as shown in FIG. 11, can include a bifurcated rotating surface such that the cables 31 can be spaced apart into two groups so as to provide a space in the center along the length 16 of the tube 11 for locating the loft blocks 39.

As shown in FIGS. 11 and 12, an embodiment of the lift system 10 can further include a tube overhead connector 66 adapted to secure the tube 11 to the overhead structure 87. The tube overhead connector 66 can include a front connector sleeve 68 and a rear connector sleeve 69. Each connector sleeve 68, 69, can be slidably disposed on the top 14 and along the length 16 of the tube 11. The tube overhead connector 66 can have two cooperating portions 67 slidable along the tube 11 away from and toward each other, and a securing mechanism to secure the cooperating portions 67 to each other and about the overhead structure 87. The securing mechanism can be, for example, a biasing mechanism configured to push the cooperating portions 67 together, or a nut and bolt adapted to pull the cooperating portions 67 together. The cooperating portions 67 of each of the front and rear connector sleeves 68, 69, respectively, can be connected to each other with a connector rod 75. The tube overhead connector 66 can further include a triangular-shaped cut-out 72 adapted to fit about a variety of thicknesses of the overhead structure 87. For example, different I-beams used as roofing structural supports 87 can have varying shapes and thickness of the flanges of the I-beam. The triangular cut-outs 72 can accommodate such varying shapes and thickness so that a particular tube overhead connector 66 can be utilized with different I-beams.

The tube overhead connector 66 can be connected to a rail (not shown) on the top 14 and along the length 16 of the tube 11. A block of material 73 can be fastened with one or more of the fasteners 74 to the inside surfaces of the front and rear legs 70, 71, respectively, of each of the front and rear connector sleeves 68, 69, respectively. The blocks of material 73 can be spaced apart such that the rail, for example, a T-shaped rail, on the top 14 of the tube 11 can fit between and rest on top of the blocks of material 73. In this manner, the tube overhead connectors 66 can be slidably secured to the tube 11. The tube overhead connector 66 can comprise various materials sufficiently strong to support the weight of the lift system 10 and associated loads. For example, the tube overhead connector 66 can be made of steel. The blocks of material 73 can comprise, for example, a nylon material that can help absorb sound between the contacting surfaces of the tube 11 and the tube overhead connector 66.

In an embodiment in which each connector sleeve 68, 69 is slidably disposed on the top 14 and along the length 16 of the compression tube 11, the tube 11 can slide, or "float," along the longitudinal axis, or length 16 of the tube 11. That is, as horizontal stress is placed on the tube 11 by pressure on the cables 31 between the drive mechanism 23 and a load attached to the cables 31, the compression tube 11 can absorb at least a portion of that horizontal stress by "compressing," or moving slightly, for example, one to two inches, in the horizontal direction between the overhead support structures 87 to which it is attached. In such an embodiment, at least one tube overhead connector 66 can fix one point of contact on the tube 11 to an overhead support structure 87, and one or more of the tube overhead connectors 66 can be slidably disposed on the tube 11. In this manner, the compression tube 11 can compress horizontally and thereby absorb horizontal stress.

As shown in FIG. 13, an embodiment of the lift system 10 can further include a load-side braking mechanism 36. Such a braking mechanism 36 can be connected to the elongate member 31 and movable within the tube 11. The braking mechanism 36 can include a pair of brake cables 76 extending the length 16 of the tube 11 and secured to each end 20, 21 of the tube 11. A pair of spaced-apart plates 77 having grooves 78 in internal faces of the plates 77 can be configured for sliding about the pair of brake cables 76. A brake assembly 79 disposed between the plates 77 can include a pivot structure 80 and a rocker arm 81 at the connection with the elongate member 31. The rocker arm 81 can be urged along an angled rocker arm guide 82 into contact with one of the brake cables 31. When tension on the elongate member 31 exerted by the drive mechanism 36 decreases below a preset threshold, the pivot structure 80 can pivot 86 so that the rocker arm 81 engages the brake cable 76, thereby stopping movement of the elongate member 31.

The brake assembly 79 can include a delay mechanism adapted to momentarily delay engagement of the brake cables 76 by the rocker arms 81 after tension on the elongate member 31 decreases below the threshold. As shown in FIG. 13, the pivot structure 80 can include a first pivot arm 83 and a second pivot arm 84 smaller than the first pivot arm 83. The first and second pivot arms 83, 84, respectively, can be connected with a pair of pivot arm connectors 85 such that when the first pivot arm 83 pivots 86 in the elongate member's path of travel, the second pivot arm 84 is also pivoted 86. The different sizes of the first and second pivot arms 83, 84, respectively, provides a mechanical advantage between the two pivot arms 83, 84 such that a small decrease in tension on the elongate member 31, for example, a momentary decrease in tension during start-up of the motor 28, will not cause the rocker arms 81 to engage the brake cables 76.

Some embodiments of the present invention can include a method for raising and lowering the article 22 in one or more directions utilizing the lift system 10 as described herein. For example, such a lift system 10 can comprise a substantially rectangular tube 11; a rotatable drum 25 external to the tube 11; a drive mechanism 23 structurally connected to one end 20 of the tube externally, and comprising a motor 28 rotatingly connected to a first traction drive 26 and operably connected to the drum 25 and to a second traction drive 27; a head block 39 fixedly connected to an opposite end 21 of the tube 11; and a loft block 32 spaced from the head block 39 and connected to the tube 11 internally. Some embodiments of such a method can include connecting the tube 11 to the overhead structure 87. The method can further include routing the elongate member 31 attached on one end to the drum 25 through a generally horizontal path of travel from the drum 25 to the first and second traction drives, 26, 27, respectively, to the head block 39, and to the loft block 32, and then through a generally vertical path of travel downward from the loft block 32. The method can further include attaching the end of the elongate member 31 opposite the drum 25 to the article 22; winding the elongate member 31 about the drum 25 to raise the article; and unwinding the elongate member 31 from the drum 25 to lower the article 22.

In some embodiments of a method, each of a plurality of the loft blocks 32 can be positioned at a different desired location selected from an infinite number of locations along a length 16 of the tube 11. The tube 11 can further comprise a substantially rigid, compressible material, and such a method can include compressing the tube 11 with at least a portion of a horizontal load placed on the lift system 10 between the drive mechanism 23 and the loft block 32. In certain embodiments, tension on the elongate member 31 can be controlled during winding and unwinding. For example, the drive mechanism 23 can include a tension clutch 37 connected to the drum 25. Varying amounts of tension can be applied with the tension clutch 37 on the drum 25 to allow the drum 25 to rotate at varying speeds relative to the rotational speed of the first traction drive 26, thereby controlling tension on the elongate member 31 during winding and unwinding.

In some embodiments of a method, movement of the article 22 can be altered, for example, slowed and/or stopped, with a load-side braking mechanism 36 connected to the elongate member 31 and movable within the tube 11. In certain embodiments, the lift system 10 may include a plurality of each of the tubes 11, the loft blocks 32, and the elongate members 31. The tubes 11 can be arranged in an end-to-end configuration, and one of the elongate members 31, or cables, can be routed about each of the loft blocks 32.

In some embodiments of a method, a sensor can be located relative to the article 22 attached to the elongate member(s) 31 to detect an obstruction in the path of travel of the article 22. A signal can be transmitted from the sensor to a controller in response to detecting the obstruction. Movement of the article 22 can then be altered in response to the transmitted signal. In certain embodiments, movement of the elongate member 31 and the attached article 22 can be controlled with a programmable controller, such as a computer 49. In particular embodiments, the lift system 10 can be controlled with a remote control device.

Some embodiments of the present invention may be utilized in applications other than those described herein. For example, certain embodiments of a lift system 10 of the present invention can be configured for operably connecting to an existing counterweight system. In such an embodiment, the lift system 10 can cooperate with existing counterweights. For example, the drive mechanism 23 can actuate the counterweights in coordination with movement of the cables 31.

Some embodiments of the present invention can be utilized to move articles or loads other than those related to performing arts and in settings other than a performing arts stage. An embodiment of the lift system 10 can be used in any setting in which there is a desire to move articles or loads, particularly in an upward and downward fashion, in a controlled manner. For example, certain embodiments of a lift assembly system 10 may be utilized to move manufacturing equipment in an industrial setting, to change advertising displays in a retail setting, or to coordinate movement of overhead equipment in a hospital operating room.

Features of a lift assembly, system, and method of the present invention may be accomplished singularly, or in combination, in one or more of the embodiments of the present invention. Although particular embodiments have been described, it should be recognized that these embodiments are merely illustrative of the principles of the present invention. Those of ordinary skill in the art will appreciate that a lift assembly, system, and method of the present invention may be constructed and implemented in other ways and embodiments. Accordingly, the description herein should not be read as limiting the present invention, as other embodiments also fall within the scope of the present invention.

What is claimed is:

1. A lift assembly comprising:

a hollow member defining a longitudinal axis;

an elongate member positioned for movement in the hollow member along a first parallel path that is substantially parallel to the longitudinal axis;

a drive mechanism coupled to move the elongate member, the drive mechanism being structurally integrated with the hollow member such that forces exerted by the drive mechanism on the elongate member are absorbed by the hollow member; and a loft block coupled to the hollow member and located to redirect the elongate member to a non-parallel path that is not parallel to the longitudinal axis.

2. The lift assembly of claim 1, wherein the elongate member comprises a cable.

3. The lift assembly of claim 1, wherein the drive mechanism comprises a drum.

4. The lift assembly of claim 1, wherein the drive mechanism is positioned at one end of the hollow member.

5. The lift assembly of claim 1, wherein the loft block is positioned at least partially within the hollow member.

6. The lift assembly of claim 1, further comprising a head block positioned to receive the elongate member along the first parallel path and direct the elongate member to a second parallel path.

7. The lift assembly of claim 6, wherein the loft block is positioned to receive the elongate member along the second parallel path and direct the elongate member to the non-parallel path.

8. The lift assembly of claim 6, wherein the head block comprises a pulley.

9. The lift assembly of claim 1, wherein the hollow member comprises a tube.

10. A lift assembly comprising:

an elongate member;

a drive mechanism including a drum on which the elongate member is wound, and a sheave directing the elongate member from a first path to a second path, wherein both the drum and the sheave are driven; and a head block positioned to receive the elongate member from the drive mechanism and direct it along a third path.

11. A lift assembly as claimed in claim 10, wherein the elongate member comprises a cable.

12. A lift assembly as claimed in claim 10, wherein the drive mechanism comprises a drum for winding the elongate member, wherein the elongate member moves from the drum along the first path, and subsequently moves to the second path, around the head block and to the third path.

13. A lift assembly as claimed in claim 10, wherein the head block comprises a pulley.

14. A lift assembly as claimed in claim 10, further including a loft block positioned to receive the elongate member along the third path and direct the elongate member to a substantially vertical fourth path.

15. A lift assembly as claimed in claim 14, where the loft block comprises a pulley.

16. A lift assembly comprising:

at least two loft blocks;

a drive mechanism adjacent a first end of the assembly;

a head block adjacent a second end of the assembly; and an elongate member driven by the drive mechanism and including a first portion extending from the first end of the assembly to the head block, a second portion extending from the head block to at least one of the loft blocks, and a third portion extending downward from the loft block.

17. A lift assembly as claimed in claim 16, wherein the drive mechanism comprises a drum.

18. A lift assembly as claimed in claim 16, wherein the head block comprises a pulley.

19. A lift assembly as claimed in claim 16, wherein the elongate member comprises a cable.

20. A lift assembly as claimed in claim 16, wherein the loft block comprises a pulley.

* * * * *